US009136100B2

(12) United States Patent
Giles et al.

(10) Patent No.: US 9,136,100 B2
(45) Date of Patent: Sep. 15, 2015

(54) TOF MASS ANALYSER WITH IMPROVED RESOLVING POWER

(71) Applicant: SHIMADZU CORPORATION, Kyoto-shi, Kyoto (JP)

(72) Inventors: Roger Giles, Manchester (GB); Matthew Clive Gill, Manchester (GB)

(73) Assignee: SHIMADZU CORPORATION, Kyoto (JP)

( * ) Notice: Subject to any disclaimer, the term of this patent is extended or adjusted under 35 U.S.C. 154(b) by 58 days.

(21) Appl. No.: 13/655,220

(22) Filed: Oct. 18, 2012

(65) Prior Publication Data

US 2013/0099111 A1 Apr. 25, 2013

(30) Foreign Application Priority Data

Oct. 21, 2011 (GB) ..... 1118270.6

(51) Int. Cl.
*H01J 49/40* (2006.01)
*H01J 49/00* (2006.01)
*H01J 49/06* (2006.01)

(52) U.S. Cl.
CPC ..... *H01J 49/401* (2013.01); *H01J 49/0031* (2013.01); *H01J 49/067* (2013.01); *H01J 49/40* (2013.01)

(58) Field of Classification Search
CPC ..... H01J 49/067
USPC ..... 250/282, 287, 288
See application file for complete search history.

(56) References Cited

U.S. PATENT DOCUMENTS

| | | | | |
|---|---|---|---|---|
| 5,017,780 | A | 5/1991 | Kutscher et al. | |
| 5,065,018 | A | 11/1991 | Bechtold et al. | |
| 5,763,878 | A | 6/1998 | Franzen | |
| 5,994,695 | A | 11/1999 | Young | |
| 6,300,626 | B1 * | 10/2001 | Brock et al. | 250/287 |
| 6,518,569 | B1 | 2/2003 | Zhang et al. | |
| 6,872,938 | B2 | 3/2005 | Makarov et al. | |

(Continued)

FOREIGN PATENT DOCUMENTS

| | | | |
|---|---|---|---|
| CA | 2349416 | A1 | 11/2002 |
| GB | 2391697 | A | 2/2004 |

(Continued)

OTHER PUBLICATIONS

Partial European Search Report for European Patent Application No. EP12188790.5 dated Nov. 5, 2013 (8 pages).

(Continued)

*Primary Examiner* — Brooke Purinton
(74) *Attorney, Agent, or Firm* — Sughrue Mion, PLLC

(57) ABSTRACT

A time of flight analyzer that comprises a pulsed ion source; a non-linear ion mirror having a turn-around point; and a detector. The pulsed ion source is configured to produce an ion pulse travelling along an ion flight axis, the ion pulse comprising an ion group consisting of ions of a single m/z value, the ion group having a lateral spread. The non-linear ion mirror is configured to reflect the ion group, at the turn-around point, along the ion flight axis towards the detector, the passage of the ion group through the non-linear ion mirror causing a spatial spread of the ion group. The time of flight mass analyzer has at least one lens positioned between the ion source and the ion mirror, wherein the or each lens is configured to reduce said lateral spread so as to provide a local minimum of lateral spread within the ion mirror.

22 Claims, 20 Drawing Sheets

(56) References Cited

U.S. PATENT DOCUMENTS

| | | | | |
|---|---|---|---|---|
| 2001/0011703 | A1 | 8/2001 | Franzen | |
| 2002/0036262 | A1 | 3/2002 | Bowdler et al. | |
| 2005/0269505 | A1 | 12/2005 | Ermer | |
| 2008/0035842 | A1 | 2/2008 | Sudakov et al. | |
| 2009/0314934 | A1 | 12/2009 | Brown | |
| 2010/0072362 | A1 | 3/2010 | Giles et al. | |
| 2010/0072363 | A1* | 3/2010 | Giles et al. | 250/287 |
| 2010/0148061 | A1 | 6/2010 | Yamaguchi et al. | |
| 2010/0193681 | A1* | 8/2010 | Vestal | 250/287 |
| 2011/0168880 | A1* | 7/2011 | Ristroph et al. | 250/282 |
| 2011/0186729 | A1* | 8/2011 | Verentchikov et al. | 250/282 |
| 2012/0193524 | A1* | 8/2012 | Flory et al. | 250/282 |

FOREIGN PATENT DOCUMENTS

| | | | |
|---|---|---|---|
| JP | 2001297730 | A | 10/2001 |
| WO | 9533279 | A1 | 12/1995 |
| WO | 03103008 | A1 | 12/2003 |
| WO | 2005001878 | A2 | 1/2005 |
| WO | 2008081334 | A2 | 7/2008 |
| WO | 2009148868 | A2 | 12/2009 |
| WO | 2010008386 | A1 | 1/2010 |

OTHER PUBLICATIONS

Gertrude F. Rempfer, "A theoretical study of the hyperbolic electron mirror as a correcting element for spherical and chromatic aberration in electron optics," Journal of Applied Physics, vol. 67, No. 10, May 15, 1990 (14 pages).

Satoh et al., "Development of a High-Performance MALDI-TOF Mass Spectrometer Utilizing a Spiral Ion Trajectory" J Am Soc Mass Spectrom, vol. 18, pp. 1318-1323, Apr. 2007.

Patrick et al., "A New Path to High-Resolution HPLC-TOF-MS—Survey Targeted, and Trace Analysis Applications of TOF-MS in the Analysis of Complex Biochemical Matrices" GC/LC Chromatography Online.com, pp. 1-9, May 1, 2011.

Satoh et al., "Tandem Time-of-Flight Mass Spectrometer with High Precursor Ion Selectivity Employing Spiral Ion Trajectory and Improved Offset Parabolic Reflectron" J. Am. Soc. Mass Spectrom, vol. 22, pp. 797-803, Mar. 2011.

Selby et al., "A 20 kV orthogonal acceleration time-of-flight mass spectrometer for matrix-assisted laser desorption/ionization" International Journal of Mass Spectrometry, vols. 210/211, pp. 89-100, Mar. 2001.

Michael et al., "An ion trap storage/time-of-flight mass spectrometer" Rev. Sci. Instrum., vol. 63, No. 10, pp. 4277-4284, Jun. 1992.

W.C. Wiley and I.H. McLaren, "Time-of-Flight Mass Spectrometer with Improved Resolution" Rev. Sci. Instrum., vol. 26, No. 12, pp. 1150-1157, Dec. 1955.

James G. Boyle and Craig M. Whitehouse, "Time-of-Flight Mass Spectrometry with an Electrospray Ion Beam" Anal. Chem, vol. 64, pp. 2084-2089, Sep. 1992.

Timothy J. Cornish and Robert J. Cotter, "A Curved Field Reflectron Time-of-Flight Mass Spectrometer for the Simultaneous Focusing of Metastable Product Ions" Rapid Communications in Mass Spectrometry, vol. 8, pp. 781-785, Jul. 1994.

* cited by examiner

TOF MASS ANALYSER WITH IMPROVED RESOLVING POWER

TECHNICAL FIELD OF THE INVENTION

The present invention relates to time-of-flight mass analysers comprising at least one non-linear ion mirror and corresponding methods of time of flight analysis.

BACKGROUND OF THE INVENTION

Reflecting time-of-flight (ToF) mass spectrometers are well known in the art. They are provided commercially for a wide range of applications, including analysis of organic substances such as pharmaceutical compounds, environmental compounds and bio molecules, including DNA and protein sequencing. In such applications, there is increasing demand for high mass accuracy, high resolution, high sensitivity and analysis speed that is compatible with gas chromatography/mass spectrometry (GC/MS) and liquid chromatography/mass spectrometry (LC/MS).

The mass resolving power of a ToF analyser may be improved by ensuring that ions of different mass to charge (m/z) values arrive at the detector spaced apart in time and that ions of a single mass to charge (m/z) value arrive at the detector as closely spaced in time as possible. It is known that the mass resolving power achieved by a reflecting time of flight mass spectrometer may be improved by lengthening the flight path. This may be done by the introduction of a Multi-reflecting ion mirror as described in WO2005/001878 or, alternatively, by providing periodic field variation in the drift direction inside planar mirrors as described in WO 2010/008386. Alternatively US 2009/0314934, US 2010/0148061 and Satoh, et al. in J. Am. Soc. Mass Spectrom. 18, 1318-1323, 2007 describe ToF systems having a series of sector fields. These systems are now realised in practice as commercially available ToF systems and can deliver mass resolving powers in the region 50 to 100 k as described by Patrick et al in GC/LC ChromatographyOnline.COM (1 May 2011) and Satoh, et al, in J. Am. Soc. Mass. Spectrom (2011) 22:797-803.

A single ToF analyser is a system in which ions undergo a single reflection from a single ion mirror. Such a system is the most commonly employed and is well known in the art of time-of-flight mass spectrometry and many examples are provided commercially. In such systems the flight path may be increased simply by increasing the distance, l, between the ion mirror and the ion source as described in International Journal of Mass Spectrometry 210/211 (2001) 89-100.

Attempts have been made to improve the duty cycle, resolving power, scan speed and mass range of time of flight mass spectrometers by using different ion sources to introduce ions into a time of flight mass spectrometer. For example, ion traps have been used for storing and preparing ions prior to their injection along a flight axis, the technique being known as Trap-ToF. There are several types of ion trap that can be used in Trap-ToF. The first instrument in this class was described by S. Michael et al., in Rev. Sci. Instrum., 1992, 63, 4277-4284, in U.S. Pat. No. 5,569,917, and in U.S. Pat. No. 5,763,878. Therein is described the use of a 3D quadrupole ion trap as an accumulator and injector into a ToF mass analyser. This type was implemented very successfully, however, the 3D quadrupole ion trap has a limited capacity for ion cloud storage, and mass range and scan speed is limited. An improvement in capacity for ion cloud storage may be gained by employing Linear ion traps or Curved ion traps, which provide an increase in the volume of ion cloud and thus increase the number of ions which can be trapped before space charge effects start to affect performance.

Franzen described an ion trap comprising parallel straight rods with ion ejection orthogonal to the rods, in U.S. Pat. No. 5,763,878. Makarov et al. describe a curved multipole rod trap with orthogonal ejection, in U.S. Pat. No. 6,872,938, and an elongated ion trap with no uniform inscribed radius along the axis was described in WO2008/081334, which was also aimed at improving the ion trap capacity. An improved method of injecting ions from an ion trap to ToF analyser was described in US2008/0035842 by employing a digital method for providing the trapping waveform, and methods to introduce ions to an ion storage trap with reduced inscribed radius was described in US2010/072362 by Giles et al. This reduction in inscribed radius is advantageous because the ion cloud within the ion trap can be made smaller and the extraction field can be made higher; both measures may provide improvement of the final mass resolving power.

In an Orthogonal-ToF (O-ToF) ions are extracted from a field free region external to the ion guide, which is the most common method of introducing ions to ToF analysers. The Orthogonal extraction method was the first method to adapt an ion beam from a continuous ion source into a pulsed ion beam necessary for a time of flight analyser: sections of the beam are pulsed in a direction orthogonal to the continuous beam. This method is commonly known as an "orthogonal Time of flight mass spectrometer" (OToF) and it is based on the original work of Wiley & McLaren in 1955 ("Time-of-Flight Mass Spectrometer with Improved Resolution", Rev. Sci. Instrum. 26, 1150-1157 (1955)).

There have been a number of methods for focusing ions into the pulsing region to improve resolving power, for example Boyle et al., in C. M. *Anal. Chem.* 1992, 64, 2084. However, the duty cycle is much lower than in the Trap-ToF method due to the duty cycle at which the continuous beam may be converted to the pulsed beam. Additionally, a proportion of ions are lost by deliberate cuffing/reduction of the ion beam to achieve a desired initial velocity and spatial distribution. Using such methods Orthogonal ToF systems have in recent years achieved mass resolving power of 35 to 40 k. This is the state of the art in current commercial systems. O-ToF is usually coupled to a two-stage reflectron. The main disadvantage of Orthogonal-ToF systems is the limitation imposed by the flight time of ions from the ion guide region to pulsing region. There have recently been a number of attempts to address the problem of the poor duty cycle of the O-ToF, see for example GB2391697 and CA 2349416 (A1), however the efficiency is still not as high as can be achieved by Trap-ToF methods.

It is known that ion sources produce ions with a range of energies. The spread of ion energies, for ions of a given mass to charge ratio (m/z ratio), places a limit on the resolving power of a ToF mass analyser. U.S. Pat. No. 6,518,569 describes how ion mirrors used in reflecting time of flight mass spectrometers can be configured to improve resolving power by providing energy focusing of the ion cloud. In general ion mirrors can be divided into two groups, linear and non-linear, according to the distribution of the electric field within the ion mirror. It has been demonstrated that non-linear ion mirrors can achieve higher resolution than linear ion mirrors (Cornish, T. J. et al., *Rapid Commun. Mass Spectrom.*, 8, 781-785 (1994)). WO03/103008 notes that an ion beam of finite diameter entering a non-linear ion mirror in a mass spectrometer will experience a range of non-linear electric fields and this reduces the resultant resolving power and laterally disperses the ion beam. However, WO03/103008 makes no suggestion as how to reduce this problem.

U.S. Pat. No. 6,518,569 states that in contrast to a linear ion mirror, a non-linear ion mirror has an electric field contour that is curved along its axis; in an ideal non-linear ion mirror the electric field should take the theoretically optimum contour along the mirror axis and an absolutely homogeneous field in the off-axis directions. This document also notes the problem that any inhomogeneity in the off-axis direction results in ion dispersion away from the ion beam centre and an inequality in flight time across an ion beam of finite width. This document suggests reducing off-axis inhomogeneity to ensure that all ions within a beam of finite width experience the same axial field.

SUMMARY OF THE INVENTION

The term ion flight axis is used herein to refer to a reference trajectory taken by an ion through the time of flight mass analyser. As the skilled person understands, an ion group has a distribution of ions about the ion flight axis.

The term "turn-around point" is used herein and the skilled person understands that the turn-around point of a non-linear ion mirror is the point at which the velocity component along the ion flight axis reaches zero for an ion following the reference trajectory.

The present application refers to x, y and z axes in the context of the ion flight axis (reference trajectory), as discussed in detail below. The energy and spatial spread of the ion group in the z- and y-directions is referred to herein as the lateral spread of the ion group, but the term radial spread could also be used (the z- and y-directions being orthogonal to the "axial" x-direction). Therefore, the terms lateral and radial can be used interchangeably.

The present inventors have observed that in practice it is not possible to improve the resolving power of a ToF analyser beyond a certain value by increasing the length of the system. The present inventors have discovered that the limitation is essentially due to the lateral spread of the ion beam as it is reflected in the ion mirror. For large distances between the ion source and ion mirror the lateral spread of the beam is dominant in the limiting of the mass resolving power of a time of flight mass spectrometer.

The lateral spread of the ion beam at any particular point on the ion flight axis is determined by the lateral spatial spread and lateral energy spread of the ions at that point.

Ions travel through a ToF mass analyser along the ion flight axis, this axis defining an x-direction (also referred to as the axial direction or direction of flight). A y-axis (defining a y-direction) and a z-axis (defining a z-direction) of the ToF mass analyser of the present invention are referred to below. The y-axis and the z-axis are mutually orthogonal and orthogonal to the ion flight axis. The skilled person will understand that as the ion flight axis is not a straight line the y-axis and the z-axis are mutually locally orthogonal and locally orthogonal to the ion flight axis.

As discussed above, mass resolving power of a ToF analyser may be improved by ensuring that ions of different mass to charge (m/z) values arrive at the detector spaced apart in time and that ions of a single mass to charge (m/z) value arrive at the detector as closely spaced in time as possible. The term ion group is used herein to mean ions of a single mass to charge (m/z) value.

Specifically, the lateral spread of the ion beam is made up of the spatial spread of the beam in z- and y-directions and the energy spread of the ion beam in z- and y-directions.

Taking the example of an ion trap, it is the lateral dimensions of the ion cloud and the spread of initial ion velocities that determines the lateral spread of the ion cloud as it passes through the ion mirror. A measure of resolving power is determined by $\Delta t$, which provides a measure of the peak width due to the arrival of species with a single m/z value at the detector (an ion group). The present inventors have noted that an initial trapped ion cloud is characterised, by $\Delta x$ (initial dimension of ion cloud in x-direction), $\Delta Vx$ (initial spread of velocities in x-direction), $\Delta z$ (initial dimension of ion cloud in z-direction), $\Delta Vz$ (initial spread of velocities in z-direction), and $\Delta y$ (initial dimension of ion cloud in y-direction), $\Delta Vy$ (initial spread of velocities in y-direction). $\Delta t$ has contributions from the terms $\Delta t|\Delta x$, $\Delta t|\Delta Vx$, $\Delta t|\Delta y$ and so on, here l denotes a vertical bar. So $\Delta t|\Delta x$ denotes the contribution to $\Delta t$ due to an initial size of the ion cloud $\Delta x$, and similarly $\Delta t|\Delta y$ denotes the contribution to $\Delta t$ due to an initial size of the ion cloud $\Delta y$. In each case one may consider first, second and higher order terms of a Taylor series expansion.

For example, $\Delta t|\Delta y = A_3\Delta y + B_3\Delta y^2 + C_3\Delta y^3 +$ etc.

For a well corrected system the terms $A_3$ and $B_3$ will be zero. Above the first order terms it is strictly necessary to consider also the combined terms, for example $B_{34}\Delta y\Delta Vy$, $B_{35}\Delta y\Delta z$, $B_{36}\Delta y\Delta Vz$ etc.

It is well known that the mass resolving power of any ToF analyser is given by $t/2\Delta t$. According to this relation it is beneficial to make the flight time (t) long to maximise resolving power. However, the present inventors have observed that proportional increase of the resolving power is not achieved with increasing flight path length (l). This is due to the growth in the terms associated with the lateral phase space of the beam, that is, the terms $\Delta y$, $\Delta Vy$ and $\Delta z$, $\Delta Vz$. As l is increased, these terms associated with the lateral phase space start to dominate the longitudinal terms $\Delta t|\Delta x$, $\Delta t|\Delta Vx$.

A single reflecting time of flight mass analyser of the prior art type is shown in FIG. 1, having an ion source comprising a ionisation source 10, and lens 11, an ion mirror 13 and a detector 14. For short drift lengths, $\Delta t$ is dominated by the longitudinal terms $\Delta t|\Delta x$, $\Delta t|\Delta Vx$. In the case of the ion trap, the term $\Delta t|\Delta x$ is determined by the energy spread of ions in the axial (direction of flight) direction. The magnitude of $\Delta t|\Delta x$ is influenced chiefly by a combination of the strength of the electrical field used to accelerate the ions and the energy acceptance of the ion mirror. The term $\Delta t|\Delta Vx$ is determined by the strength of the electrical field used to accelerate ions from the ion trap only. $\Delta t|\Delta Vx$ defines the limit of the resolving power for a given ion source: the reflectron can not correct this contribution. The two longitudinal effects $\Delta t|\Delta x$ and $\Delta t|\Delta Vx$ are invariant to l, but the contributions of the radial terms of $\Delta t|\Delta y$, $\Delta t|\Delta Vy$, $\Delta t|\Delta z$, and $\Delta t|\Delta Vz$ are strongly dependent on l, the distance between the ion mirror and the ion source.

The present inventors have applied this understanding and insight to the problem of improving mass resolution, and at its most general the present inventors provide a number of proposals wherein a ToF mass analyser is configured to reduce the contribution of one or more of the lateral terms to provide temporal focusing of an ion group at the detector, thereby improving the mass resolution of the time of flight mass analyser.

A first proposal is that a time of flight mass analyser is provided with at least one lens positioned between the ion source and the ion mirror for improving the temporal focus of an ion group at the detector. Improved temporal focusing is provided by limiting the growth in lateral terms $\Delta t|\Delta y$, $\Delta t|\Delta Vy$ and $\Delta t|\Delta z$, $\Delta t|\Delta Vz$ with increasing flight path length.

A second proposal is that a time of flight mass analyser is provided with an ion mirror having a lensing portion to improve the temporal focus of an ion group at the detector.

Improved temporal focusing is provided by collimating reflected ions within the ion mirror.

A third proposal is that a time of flight mass analyser is provided with at least one lens positioned between the ion mirror and the detector for improving the temporal focus of an ion group at the detector. Improved temporal focusing is achieved by reducing the lateral divergence of reflected ions.

As discussed below each of these proposals may be used independently or in combination with one or both of the other proposals to provide improved temporal focusing of an ion group at the detector thereby improving the mass resolution of a time of flight mass analyser.

The present proposals seek to improve the mass resolution provided by a reflecting time of flight mass spectrometer. Embodiments of the present invention seek to counteract or ameliorate the problem identified by the present inventors as discussed herein. In particular, ions in an ion beam of finite diameter experience a range of non-linear electric fields when entering a non-linear ion mirror, causing ions of a single m/z value to take paths of different length through the ion mirror, resulting in an increase in lateral terms $\Delta y$, $\Delta Vy$, $\Delta z$, and $\Delta Vz$ for the ion group. This increase in lateral aberration of the ion group causes ions of an ion group to arrive at the detector at different times, resulting in an increased peak width $\Delta t$. As discussed herein, embodiments of the present invention can reduce the problem of the ion mirror degrading the time focus of a time of flight mass analyser, by, for example, reducing the lateral spread of the ions.

Whilst the proposals are not limited to single-reflection ToF mass analysers, they are described here with reference to a single-reflection ToF mass analyser.

In respect of the first proposal, the problem of the ion mirror degrading the time focus of a time of flight mass analyser is at its most general addressed by providing a time of flight mass analyser comprising at least one lens positioned between the ion source and the ion mirror, the or each lens configured to improve the temporal focus at the detector by reducing the lateral spread of the ion group in the region of the turn-around point of the ion mirror.

In a first aspect the present invention provides a time of flight analyser comprising:

a pulsed ion source;

a non-linear ion mirror having a turn-around point;

a detector;

an ion flight axis extending from the pulsed ion source to the detector via the turn-around point of the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group, at the turn-around point, along the ion flight axis towards the detector, the passage of the ion group through the non-linear ion mirror causing a spatial spread of the ion group in the x-direction at the detector due to the lateral spread of the ion group within the ion mirror, the time of flight mass analyser having at least one lens positioned between the ion source and the ion mirror, wherein the or each lens is configured to reduce said lateral spread so as to provide a local minimum of lateral spread within the ion mirror thereby reducing the spatial spread of the ion group in the x-direction at the detector.

Thus, in use, the or each lens positioned between the ion source and the ion mirror reduces the lateral spread of the ion group at the turn-around point in the ion mirror. This reduction in lateral spread of the ion group within the ion mirror reduces the range of path lengths taken by different ions through the ion mirror. Reducing the range in path length taken by different ions of the ion group results in a reduced range in the time of flight for the same ions, i.e. a decreased $\Delta t$. This in turn reduces the x-direction spatial spread caused by the ion group passing through the ion mirror. Suitably the reduction in spatial spread in the x-direction at the detector is a local minimum of spatial spread in the x-direction at the detector. Additionally or alternatively the local minimum is provided in a region corresponding to 20% or less of the distance from the surface of the detector to the ion mirror. That is, an aspect of the present invention the provision of the local minimum of lateral spread within the ion mirror thereby provides a local minimum of spatial spread in the x-direction in a region corresponding to 20% or less of the distance from the surface of the detector to the ion mirror. Suitably the function of reducing spatial spread in the x-direction at the detector is minimising the spatial spread of the ion group in the x-direction at the detector.

Therefore, the or each lens positioned between the ion source and the ion mirror results in the time of flight mass analyser having improved mass resolution. The at least one lens positioned between the ion source and the ion mirror can be referred to as a pre-mirror lateral spread reduction lens.

Reducing the lateral spread of the ion group within the ion mirror, suitably at the turn-around point, in only one of the y- or z-directions is sufficient to improve the mass resolution of a time of flight mass analyser. Accordingly, in embodiments, reduction of the lateral spread is selected from reduction in the y-direction, reduction in the z-direction and reduction in the y- and z-directions. Similarly, the provision of the local minimum of lateral spread within the ion mirror can be selected from a local minimum in the y-direction, local minimum in the z-direction and local minimum in the y- and z-directions.

Preferably the or each lens is configured to reduce said lateral spread to a local minimum in the z- and/or y-directions within the ion mirror, suitably at or near the turn-around point of the non-linear ion mirror.

Reducing the lateral spread of the ion group to a local minimum in this way minimises the lateral aberrations. Therefore, reducing the lateral spread of the ion group to a local minimum improves mass resolution by limiting the growth of terms $\Delta tl\Delta y$, $\Delta tl\Delta Vy$, $\Delta tl\Delta z$ and $\Delta tl\Delta Vz$ caused by the ion group passing through the ion mirror.

Suitably the time of flight analyser comprises a single ion mirror (i.e. does not comprise a multi-reflecting ion mirror).

Suitably the pulsed ion source has an acceleration region.

The present invention may apply equally to all prior art methods of preparing ions for ToF analysis, and all systems having an ion source. Therefore the ion source may be any ion source, including those discussed above. For example, the ion source may comprise an Orthogonal-ToF ion source, preferably an ion Trap-ToF ion source or a bunching ion guide-ToF ion source. Suitably, the ion source comprises a storage ion trap.

Preferably the detector has a temporal resolution of at least 1 ns, more preferably of at least 0.5 ns and most preferably of at least 0.25 ns. Suitably the detector has a low jitter response, preferably of at least 1 ns, more preferably of at least 0.25 ns. Suitably the detector has a high dynamic range of response suitably of at least 2 orders, and more preferably 3 orders and most preferably 4 orders of magnitude.

In embodiments, the or each lens comprises a y lens configured to reduce the lateral spread of the ion group (and provide a corresponding local minimum) in the y-direction within the ion mirror, suitably at the turn-around point. In this way it is possible to reduce the spatial spread of an ion group, caused by the ions of an ion group taking different paths through the ion mirror, in the x-direction at the detector.

In embodiments, the or each lens comprises a z lens configured to reduce the lateral spread of the ion group (and provide a corresponding local minimum) in the z-direction within the ion mirror, suitably at the turn-around point. In this way it is possible to reduce the spatial spread of an ion group, caused by ions of an ion group taking different paths through the ion mirror, in the x-direction at the detector.

In embodiments, the or each lens comprises a y-z lens configured to reduce the lateral spread of the ion group (and provide a corresponding local minimum) in both the z- and y-directions within the ion mirror, suitably at the turn-around point. In this way it is possible to reduce the spatial spread of an ion group, caused by ions of an ion group taking different paths through the ion mirror, in the x-direction at the detector.

Suitably there are two or more lenses, although in some embodiments there is only one lens. If there are two or more lenses, preferably there is a y lens and a z lens.

In embodiments, only one lens is positioned between the ion source and the ion mirror, this lens being configured to reduce the lateral spread of the ion group (and provide a corresponding local minimum) in both the z-direction and the y-direction within the ion mirror, suitably at the turn-around point. In this way it is possible to reduce the spatial spread of an ion group, caused by ions of an ion group taking different paths through the ion mirror, in the x-direction at the detector.

Preferably the or each lens comprises a plurality of electrodes and a voltage supply means configured to produce a focusing field.

In embodiments where at least one lens is configured to reduce the lateral spread of the ion group (and provide a corresponding local minimum) in both the z- and y-directions within the ion mirror, suitably at the turn-around point, the or each lens is preferably a multipole lens.

Optionally the or each lens is a single lens, for example an einzel lens, or an octopole lens, or 12 pole lens, or higher order multipole lens.

Suitably the voltages applied to the or each octopole or 12 pole or higher order lens are applied as Mod [sin(θ)] where θ is the pole angle.

The present inventors have noticed that the positioning of the or each lens between the ion source and the turn-around point is important. If the or each lens is placed in close proximity to the ion source, the lens requires that the object distance must be small and the image distance must be large, and therefore there must effectively be a large magnification. Although it is possible to focus the ions to reach the detector, it can be difficult to reduce lateral spread of the ion group to a local minimum at or near the turn-around point of the ion mirror. The difficulty is also compounded by the optical effects due to the fact that the ion group has a finite size in the x-direction (Δx): ions originating at differing values of x will be focused to different locations, thus enlarging the lateral spread of the ion group in the ion mirror further. Put another way, a lens placed close to the ion source has a short 'depth of focus' (it is analogous to physical optics).

In embodiments, the or each lens is positioned within the region corresponding to 10% to 70% of the distance from the ion source (initial ion position) to the turn-around point of the ion mirror. Preferably the or each lens is positioned within 15% to 50%, or more preferably 20% to 40% of the distance from the ion source to the turn-around point of the ion mirror. The positioning of the or each lens within this range has been found to be particularly effective in reducing the lateral spread of the ion group to a local minimum within the ion mirror, suitably at or near the turn-around point.

The present inventors have found that the placement of the or each lens limits the growth in the terms ΔtlΔy, ΔtlΔVy and ΔtlΔz, ΔtlΔVz with increasing flight path length. Therefore the or each lens can bring about a significant improvement in the system resolving power, particularly when the flight path is lengthened.

The present inventors have noticed that non-linear ion mirrors cause divergence of the ion group on reflection, due to a strong focusing effect provided by an ion mirror and may cause a 'cross over' of ion paths within the ion mirror. These strong focusing effects can contribute to a reduction in resolving power. The present inventors have found that the divergence of the ion group on reflection at the ion mirror can be corrected or ameliorated by adding a lensing portion to the ion mirror to collimate the reflected ion group within the ion mirror. In other words, the lateral spread arising from divergence of the ion group as a result of passing through the ion mirror can be addressed by modifying or adapting the ion mirror so that it comprises a portion that provides a lensing effect.

In embodiments the non-linear ion mirror comprises a lensing portion, wherein the lensing portion is configured to reduce the lateral spread of the ion group within the ion mirror so as to reduce the spatial spread, caused by passing through the ion mirror, of the ion group in the x-direction at the detector. The lensing portion is configured to reduce the lateral spread of the ion group within the ion mirror so as to improve the time focus of the ion group at the detector. Suitably the ion mirror comprising the lensing portion reduces the divergence of the reflected ion group compared to that for an ion mirror without the lensing portion.

Preferably the lensing portion comprises a plurality of electrodes and a voltage supply means configured to produce a laterally focusing field.

In embodiments the lensing portion is configured to reduce the lateral spread of the ion group in the y-direction within the ion mirror.

In embodiments the lensing portion is configured to reduce the lateral spread of the ion group in the z-direction within the ion mirror.

In embodiments the lensing portion is configured to reduce the dimensions of the ion group in both the y- and z-directions within the ion mirror.

The present inventors have also found that the divergence of the ion beam (and hence lateral spread at the detector) on reflection due to a strong focusing effect provided by an ion mirror can be corrected or ameliorated by positioning a lens between the ion mirror and the detector.

Thus, suitably, the time of flight analyser comprises at least one lens positioned on the ion flight axis between the non-linear ion mirror and the detector, wherein the or each lens is configured to reduce said lateral spread at the detector. By reducing the lateral spread at the detector, a reduction in spatial spread in the x-direction at the detector can be achieved. The at least one lens positioned between the non-linear ion mirror and the detector can be referred to as a post-mirror lateral spread reduction lens.

In embodiments the time of flight analyser comprises at least one first lens (pre-mirror lateral spread reduction lens) positioned on the ion flight axis between the ion source and the non-linear ion mirror and at least one second lens (post-mirror lateral spread reduction lens) positioned on the ion flight axis between the non-linear ion mirror and the detector, the first and second lenses being configured to reduce the lateral spread of the ion group so as to reduce the spatial spread of the ion group, caused by the ion group passing through the ion mirror, in the x-direction at the detector.

The or each lens positioned on the ion flight axis between the non-linear ion mirror and the detector reduces the divergence of the reflected ion group caused by the non-linear ion mirror. Reducing the divergence of the ion group results in improved temporal focusing of the ion group at the detector.

In embodiments, at least one second lens is a z lens configured to reduce the lateral spread of the ion group in the z-direction so as to reduce the spatial spread of the ion group, caused by the ion group passing through the ion mirror, in the x-direction at the detector.

In embodiments, at least one second lens is a y lens configured to reduce the lateral spread of the ion group in the y-direction so as to reduce the spatial spread of the ion group, caused by the ion group passing through the ion mirror, in the x-direction at the detector.

In embodiments, at least one lens positioned between the ion mirror and the detector is configured to reduce the lateral spread of the ion group in both the z- and y-directions so as to reduce the spatial spread of the ion group, caused by the ion group passing through the ion mirror, in the x-direction at the detector.

In embodiments, only one lens is positioned between the ion mirror and the detector, this lens being configured to reduce the lateral spread of the ion group in both the z-direction and the y-direction so as to reduce the spatial spread of the ion group, caused by the ion group passing through the ion mirror, in the x-direction at the detector.

Preferably the or each second lens is configured to reduce the lateral spread of the ion group to a local minimum at or near the detector so as to achieve temporal focusing of the ion group at the detector. Reducing lateral spread of the ion group at the detector also reduces the axial (x-direction) spread of the ion group if the system has introduced an inclination of the incident ion group with respect to the surface of the detector as discussed below.

As used herein "near the detector" suitably means within 50% of the distance from the surface of the detector to the turn-around point of the mirror, preferably within 40%, more preferably within 30%, more preferably within 20%, more preferably within 15%, and most preferably within 10%.

In embodiments, the or each second lens is positioned within the region corresponding to 10% to 70% of the distance from the turn-around point of the ion mirror to the surface of the detector. Preferably the or each second lens is positioned within 20% to 70%, more preferably 35% to 45% of the distance from the turn-around point of the ion mirror to the surface of the detector. The positioning of the or each second lens within these ranges has been found to be particularly effective at reducing the lateral spread of the ion group to a local minimum at or near the detector so as to minimise the axial (x-direction) spread of the ion group when it arrives at the detector.

In a related aspect, the present invention provides a method corresponding to the apparatus of the first aspect. In particular, the present invention provides a method of mass analysis comprising the steps of: producing an ion pulse travelling in an axial direction (x-direction) along an ion flight axis, the ion flight axis extending from a pulsed ion source to a detector via a turn-around point of a non-linear ion mirror, the ion pulse having an ion group, the ion group consisting of ions with a single m/z value, the ion group having a lateral spread; reflecting the ion group at the turn-around point of the non-linear ion mirror along the ion flight axis towards the detector, the passage of the ion group through the non-linear ion mirror causing an axial spatial spread of the ion group at the detector due to the lateral spread of the ion group within the ion mirror; wherein the method includes reducing the lateral spread of the ion group so as to provide a local minimum of lateral spread within the ion mirror, suitably at the turn-around point, thereby reducing the spatial spread of the ion group in the axial direction (x-direction) at the detector.

Suitably the optional and preferred features associated with the apparatus also apply to the method. That is, for each recited function, means or feature of the apparatus, there is a corresponding method feature or step.

Preferably the lateral spread of the ion group is reduced to a local minimum at or near the turn-around point.

In embodiments, the method comprises a step of reducing the lateral spread of the ion group within the non-linear ion mirror after reflection of the ion group so as to reduce the spatial spread of the ion group, caused by the ion group passing through the ion mirror, in the axial direction at the detector.

In embodiments, the method comprises a step of reducing the lateral spread of the ion group between the ion mirror and the detector so as to reduce the spatial spread of the ion group, caused by the ion group passing through the ion mirror, in the x-direction at the detector.

Suitably the method includes detecting the ions.

In a related aspect the present invention also provides a method of using the mass analyser of the first aspect in a method of mass analysis.

In a related aspect the present invention also provides a lens system (pre-mirror lateral spread reduction lens system) comprising at least one lens for use in the mass analyser of the first aspect. Thus, the or each lens of the lens system is configured to reduce said lateral spread so as to provide a local minimum of lateral spread within the ion mirror, suitably at the turn-around point, thereby reducing the spatial spread of the ion group, caused by the ion group passing through the ion mirror, in the x-direction at the detector. Suitably the lens system comprises a plurality of electrodes and a voltage supply means configured to produce a focusing field.

The present inventors have found that the advantages associated with the first aspect also apply to these aspects.

In respect of the second proposal, at its most general the problem of the non-linear ion mirror degrading the time focus of a time of flight mass spectrometer is addressed by providing an ion mirror having a lensing portion.

As discussed above, the present inventors have noticed that a non-linear ion mirror can cause divergence of the ion group on reflection, for example because of a strong focusing effect provided by the ion mirror causing cross over of ion paths within the ion mirror. As noted above, this increased lateral spread of the ion group can in turn result in an increased spatial spread in the x-direction (i.e. along the ion flight axis) at the detector, especially if there is formed by the non-linear ion mirror an inclination of the incident ion group with respect to the surface of the detector.

The present inventors have found that divergence of the ion group on reflection at the ion mirror can be corrected or ameliorated by adapting the ion mirror so that it comprises a lensing portion to collimate the reflected ion group within the ion mirror.

In a further aspect the present invention provides a time of flight mass analyser comprising:

a pulsed ion source;

a non-linear ion mirror;

a detector;

an ion flight axis extending from the pulsed ion source to the detector via the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group along the ion flight axis towards the detector, the non-linear ion mirror causing a lateral spread of the ion group resulting in a spatial spread of the ion group in the x-direction at the detector, the non-linear ion mirror having a lensing portion configured to reduce said lateral spread within the ion mirror so as to reduce the spatial spread of the ion group in the x-direction at the detector.

The lensing portion of the ion mirror suitably provides collimation of reflected ion group in xz and/or xy plane without deterioration of the energy focusing of the ion mirror at the detector, that is the deterioration of the temporal focusing term ΔtlΔx by reducing the orthogonal radial aberrations terms; ΔtlΔy, ΔtlΔVy ΔtlΔz and ΔtlΔVz.

In this way the x-direction spatial spread caused by the ion group passing through the ion mirror can be reduced, suitably minimised.

Although it is not necessary for an ion group to be laterally focused at the detector in order for the ions to be detected, a divergent ion group may result in an inclination of the path taken by ions within the ion group relative to the detector. This inclination causes deterioration in temporal focus at the detector. If the ion mirror is configured to produce a collimated ion group exiting the ion mirror the detrimental effect on the temporal focus can be reduced.

Preferably the lensing portion comprises a plurality of electrodes and a voltage supply means configured to produce a laterally (radially) focusing field.

In embodiments the lensing portion may extend the full length of the ion mirror. Optionally the lensing portion may extend over one or a plurality of discrete portions of the ion mirror. In some embodiments no additional electrodes are needed compared to those of a standard multi-electrode non-linear ion mirror. In other embodiments the lensing portion may have electrodes of differing size or shape compared to other electrodes of the ion mirror. Thus, in embodiments the ion mirror comprises a first set of electrodes and a second set of electrodes, the second set being different (e.g. a different size and/or a different shape) from the first set, wherein the first set corresponds to the lensing portion. The differing size or shape is chosen in locations where strong lens actions is needed, this assists the provision of lower voltage differentials between adjacent electrodes of the ion mirror.

In embodiments the lensing portion is located at a forward or front part of the ion mirror. The lensing portion is suitably located at the entrance (or exit) portion of the ion mirror.

In embodiments, the lensing portion is configured to reduce the lateral spread of the ion group within the ion mirror in the y direction so as to reduce the axial spread, caused by the ion mirror, of the ion group at the detector. In this embodiment the lensing portion of the ion mirror provides collimation of the reflected ion group in the xy plane. The lensing portion reduces the difference in the flight time taken by different ions within an ion group due to the lateral spread of the ion group as it enters the ion mirror. The lensing portion reduces the lateral spread of the ion group within the ion mirror. Preferably the lensing portion is configured to collimate ions within the ion group in the xy plane within the ion mirror to produce a collimated ion group exiting the ion mirror.

In embodiments, the lensing portion is configured to reduce the lateral spread of the ion group within the ion mirror in the z direction so as to reduce the axial spread, caused by the ion mirror, of the ion group at the detector. In this embodiment the lensing portion of the ion mirror provides collimation of the reflected ion group in the xz plane by reducing the lateral spread of the ion group in the z-direction within the ion mirror. Preferably the lensing portion is configured to collimate ions within the ion group in the xz plane within the ion mirror to produce a collimated ion group exiting the ion mirror.

Preferably the lensing portion of the non-linear ion mirror comprises a plurality of separate lenses. The plurality of separate lenses are suitably configured to provide, in combination, collimation of the reflected ion group in the xy plane and/or the xz plane at the detector without deterioration of the temporal focus.

In embodiments the ion mirror includes elements dedicated to energy focusing and elements dedicated to spatial focusing.

Suitably the non-linear ion mirror may be formed with circular, oval or, rectangular cross sections electrodes or from plate electrodes.

The present inventors have found that the advantages associated with the other aspects also apply to this aspect.

In a related aspect, the present invention provides a method corresponding to the apparatus of this ion mirror having a lensing portion. In particular, the present invention provides a method of mass analysis comprising the steps of; producing an ion pulse travelling in axial (x-direction) along an ion flight axis, the ion flight axis extending from a pulsed ion source to a detector via a turn-around point of a non-linear ion mirror, the ion pulse having an ion group, the ion group consisting of ions with a single m/z value, the ion group having a lateral spread; reflecting the ion group at the turn-around point of the non-linear ion mirror towards the detector, the ion mirror causing a lateral spread of the ion group resulting in a spatial spread of the ion group in the axial direction (x-direction) at the detector; wherein the method includes reducing the lateral spread within the ion mirror so as to reduce the spatial spread of the ion group in the axial direction (x-direction) at the detector.

Suitably the method includes detecting the ions.

In a related aspect the present invention also provides a method of using the mass analyser comprising a lensing portion of the above aspect in a method of mass analysis.

In a related aspect the present invention also provides a non-linear ion mirror comprising a lensing portion for use in a mass analyser as described above. Thus, the lensing portion is configured to reduce said lateral spread within the ion mirror so as to reduce the spatial spread, caused by the ion group passing through the ion mirror, of the ion group in the x-direction at the detector.

Suitably the optional and preferred features associated with the apparatus having an ion-mirror with a lensing portion also apply to the method. That is, for each recited function, means or feature of the apparatus, there is a corresponding method feature or step.

The present inventors have found that the advantages associated with the other aspects also apply to this aspect.

In respect of the third proposal, at its most general the problem of the ion mirror degrading the time focus of a time of flight mass spectrometer is addressed by providing a time of flight mass analyser comprising at least one lens positioned between the ion mirror and the detector.

As discussed above, the present inventors have noticed that ion mirrors cause divergence of the ion group on reflection, due to a strong focusing effect provided by an ion mirror and commonly causing cross over of ion paths within the ion mirror. The present inventors have also found that the divergence of the ion beam on reflection can be corrected or ameliorated by positioning a lens between the ion mirror and the detector (which lens can be referred to as a post-mirror lateral spread reduction lens).

In a further aspect the present invention provides a time of flight mass analyser comprising:

a pulsed ion source;

a non-linear ion mirror;

a detector;

an ion flight axis extending from the pulsed ion source to the detector via the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group along the ion flight axis towards the detector, the non-linear ion mirror causing a lateral spread of the ion group resulting in a spatial spread of the ion group in the x-direction at the detector, the time of flight mass analyser having at least one lens positioned between the ion mirror and the detector, wherein the or each lens is configured to reduce said lateral spread so as to reduce the spatial spread of the ion group in the x-direction at the detector.

Thus, in embodiments the or each lens positioned on the ion flight axis between the non-linear ion mirror and the detector (post-mirror lateral spread reduction lens) reduces the lateral divergence of the reflected ion group at the detector caused by the non-linear ion mirror. Reducing the divergence of the ion group results in improved focusing in time of the ion group at the detector. In this way the x-direction spatial spread caused by the ion group passing through the ion mirror can be reduced, suitably minimised.

Preferably the or each lens is configured to reduce the lateral spread to a local minimum at or near the detector so as to achieve temporal focusing of the ion group at the detector. Reducing lateral spread of the ion group at the detector will also reduce the axial spread of the ion group if the system has introduced an inclination of the incident beam with respect to the surface of the detector, as discussed above.

In embodiments the or each lens includes a y lens configured to reduce the lateral spread of the ion group in the y-direction so as to reduce the spatial spread, caused by the ion group passing through the ion mirror, of the ion group in the x-direction at the detector.

In embodiments the or each lens includes a z lens configured to reduce the lateral spread of the ion group in the z-direction so as to reduce the spatial spread, caused by the ion group passing through the ion mirror, of the ion group in the x-direction at the detector.

In embodiments one lens reduces the lateral spread of the ion group in both the y-direction and the z-direction between the ion mirror and the detector.

Preferably the or each lens comprises a plurality of electrodes and a voltage supply means configured to produce a laterally focusing field.

In embodiments, the or each lens is positioned within a region corresponding to 10% to 70% of the distance from the turn-around point of the ion mirror to the surface of the detector. Preferably the or each lens is positioned within 20% to 70%, more preferably 35% to 45%, more preferably about 40% of the distance from the turn-around point of the ion mirror to the surface of the detector. The positioning of the or each lens within this region has been found to be particularly effective at minimising the lateral spread of the ion group so as to minimise the x-direction spread of the ion group when it arrives at the detector.

The present inventors have found that the advantages associated with the other aspects also apply to this aspect.

In a related aspect, the present invention provides a method corresponding to the apparatus with at least one lens positioned between the ion mirror and the detector. In particular, the present invention provides a method of mass analysis comprising the steps of: producing an ion pulse travelling in an axial (x-direction) along an ion flight axis, the ion flight axis extending from a pulsed ion source to a detector via a turn-around point of a non-linear ion mirror, the ion pulse having an ion group, the ion group consisting of ions with a single m/z value, the ion group having a lateral spread; reflecting the ion group at the turn-around point of the non-linear ion mirror towards the detector, the ion mirror causing a lateral spread of the ion group resulting in a spatial spread of the ion group in the axial direction (x-direction) at the detector; wherein the method includes reducing the lateral spread after the ion mirror so as to reduce the spatial spread of the ion group in the axial direction (x-direction) at the detector.

Suitably the method includes detecting the ions.

In a related aspect the present invention also provides a method of using the mass analyser comprising at least one lens positioned between the ion mirror and the detector of the above aspect in a method of mass analysis.

In a related aspect the present invention provides a lens system (post-mirror lateral spread reduction lens system) comprising at least one lens for use in the mass analyser of the above aspect. Thus, the or each lens of the lens system is configured to reduce the lateral spread after the ion mirror so as to reduce the spatial spread of the ion group in the axial direction (x-direction) at the detector.

Suitably the lens system comprises a plurality of electrodes and a voltage supply means configured to produce a focusing field.

Suitably the optional and preferred features associated with the apparatus with at least one lens positioned between the ion mirror and the detector also apply to the method. That is, for each recited function, means or feature of the apparatus, there is a corresponding method feature or step.

The present inventors have found that the advantages associated with the other aspects also apply to this aspect.

In a further aspect the present inventors have found that the above aspects may be applied to a multi-reflecting time of flight mass spectrometer with the same advantages as those discussed herein.

The optional and preferred features of any one aspect can also apply to any of the other aspects. Furthermore, features disclosed in the context of a product (ToF mass analyser) may also apply to a method as a corresponding method step, and vice versa.

BRIEF DESCRIPTION OF THE DRAWINGS

Embodiments of the invention and information illustrating the advantages and/or implementation of the invention are described below, by way of example only, with respect to the accompanying drawings in which.

DETAILED DESCRIPTION OF EMBODIMENTS AND EXPERIMENTS

Figure 1:
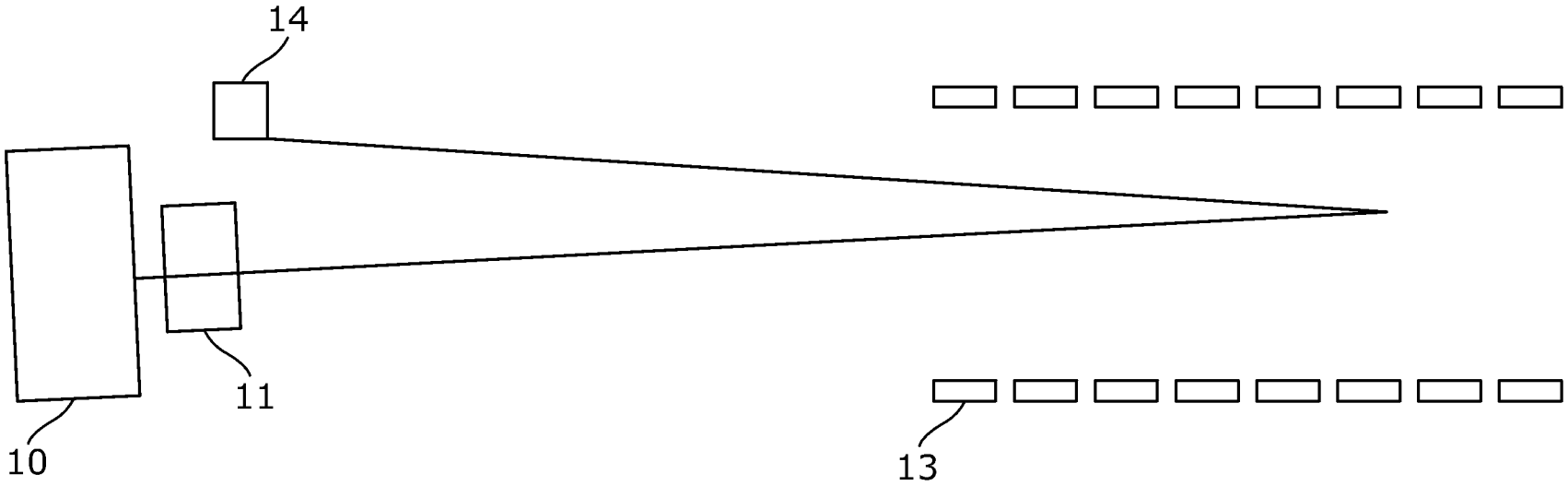
Figure 1 Prior Art
FIG. 1 shows a schematic diagram of a prior art single-reflecting ToF mass analyser.

FIG. 1 shows an example of a prior art system, such as that described in U.S. Pat. No. 6,717,132 B2, having an O-ToF ion source 10 that does not contain grids for defining the accelerating electric field, a lens 11 in close proximity to the ion source, the lens focusing the extracted beam so that it does not strongly diverge, and that a reasonable proportion of the total ion population reaches the ion mirror and the detector, an ion mirror 13 and a detector 14.

Note however that this lens 11 is not capable of minimising the lateral spread of ions at the turn-around point of the ion mirror 13 so as to minimise the spatial spread of the ions, caused by passage through the mirror 13, in the axial direction (x-direction) at the detector. The present inventors' observations regarding lenses of this sort in close proximity to the ion source are discussed above.

Figure 2:
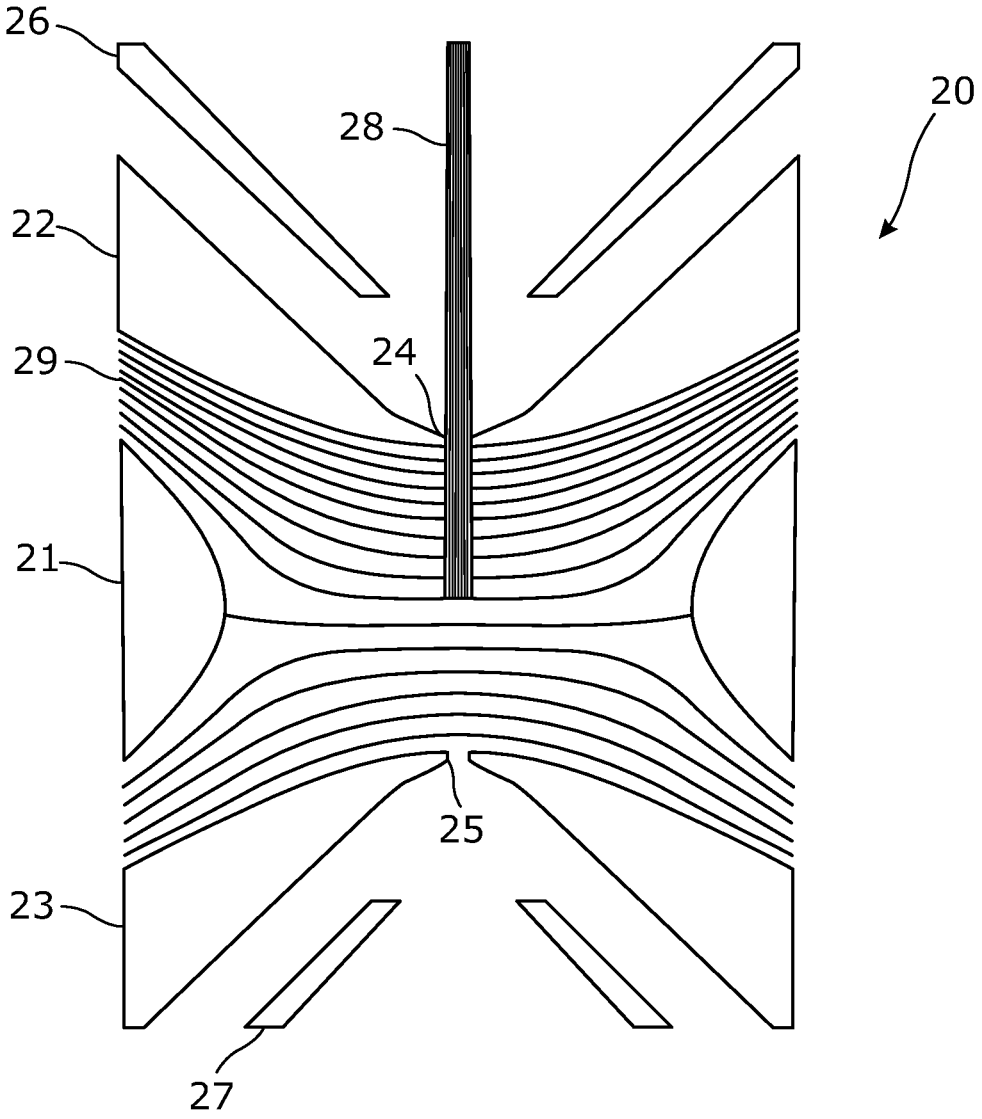
FIG. 2 shows a schematic diagram of an ion trap of the prior art.

FIG. 2 illustrates an ion trap 20 of the prior art, ions are guided into the ion trap 20 by ion gate electrode 27 and enter the ion trap through ion entrance aperture 25 due to the voltage applied to ion gate electrode 27. A trapping voltage is applied to ring electrode 21, ions are extracted from the ion trap 20 by an extraction voltages applied to first end cap electrode 23 and second end cap electrode 22, through aperture 24 in the second end cap electrode. Extracted ions are focused by a field generated between focusing electrode 26 and second end cap electrode 22, ions are focused into ion beam 28 so that they may be collected in the ion mirror and the detector. Ion trajectories produced by focusing electrode 26 are shown by lines 29 in FIG. 2. Ion traps of this sort can be used as an ion source.

Figure 3:
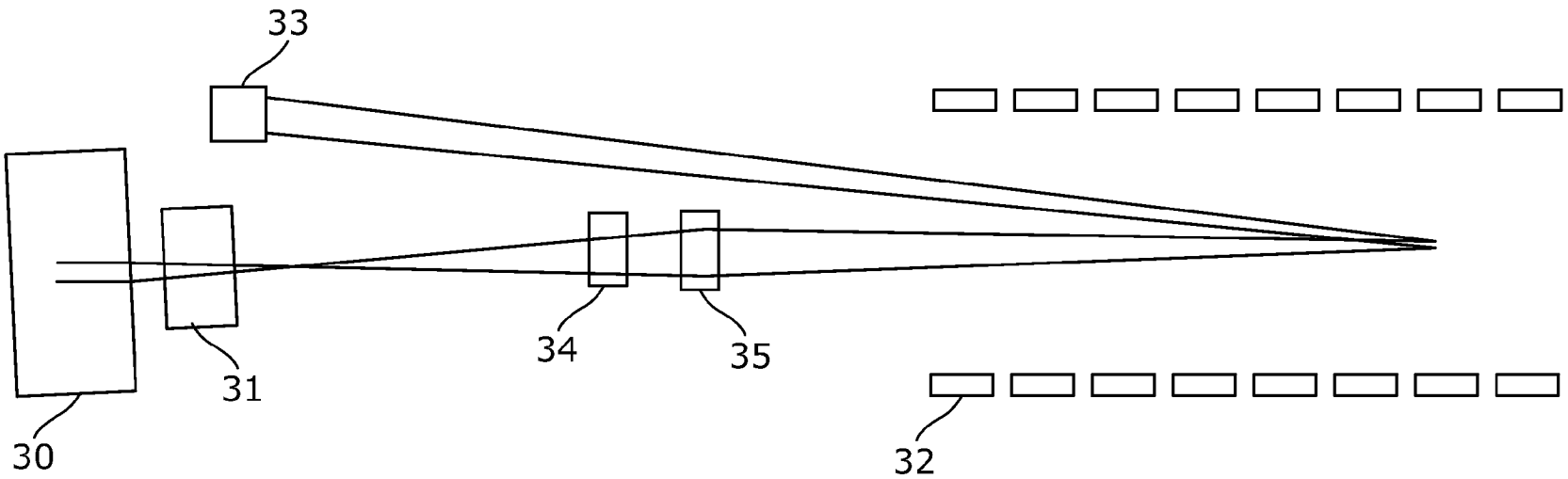
FIG. 3 shows a schematic diagram of a single-reflecting ToF mass analyser being an embodiment of the present invention.

FIG. 3 shows a time of flight mass analyser of the present invention having a y lens 34 and a z lens 35 positioned between the ion source and the detector, these lenses employed to minimise the lateral spread of the ion beam in the ion mirror. This figure shows a typical system in the xy plane, where the x-direction is defined by the ion flight axis and the y-direction is the direction of deflection by the ion mirror. Z lens 34 is used to reduce the lateral spread of the ion group in the z direction, and y lens 35 is used to reduce the lateral spread of the ion group in the other lateral direction (y).

Figure 4:
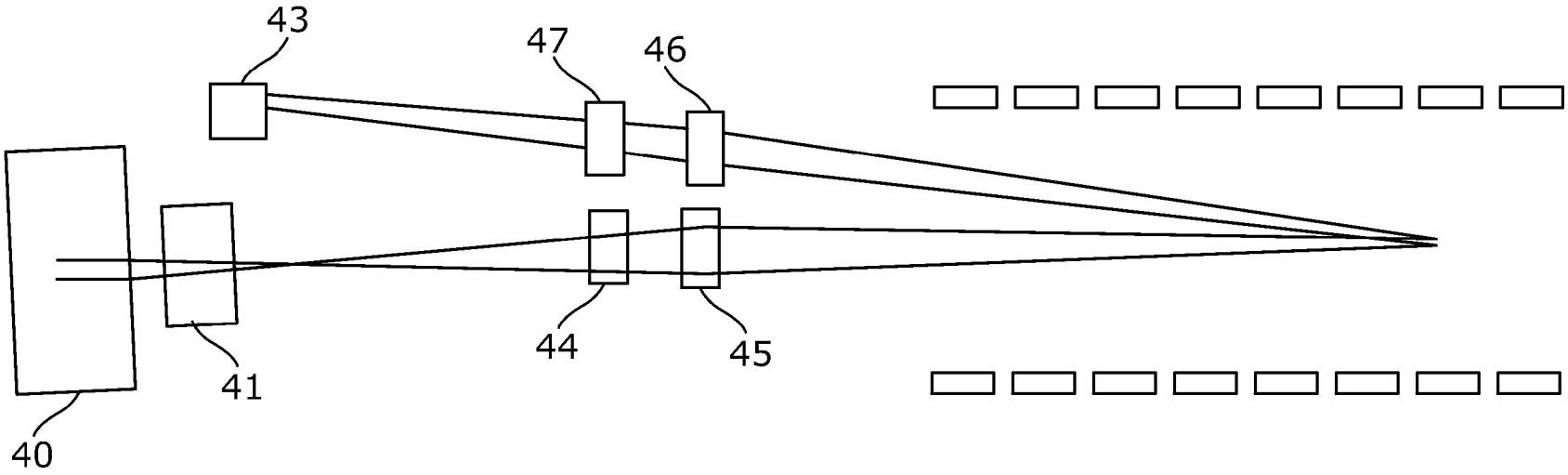
FIG. 4 shows a schematic diagram of a single-reflecting ToF mass analyser being an embodiment of the present invention.

FIG. 4 illustrates another preferred embodiment; also shown in the xy plane, the time of flight mass analyser includes, in addition to a first z lens 44 and a first y lens 45 as described above for FIG. 3, a second y lens 46 and a second z lens 47 positioned between the ion mirror and the detector, on the ion flight axis, configured to reduce the lateral spread of the ion group before the detector. Reducing the lateral spread of the ion group before the detector brings a further reduction in the temporal spread of ions of a single m/z, value at the detector and thus further improvements in the time resolving power and thus mass resolving power of the instrument. In this example second y lens 46 reduces the lateral spread of the ion group in the y-direction, and second z lens 47 reduces the lateral spread of the ion group in the z-direction. As this figure illustrates, the at least one lens positioned between the ion mirror and the detector may comprise separate y and z lenses, one lens being used to achieve focusing in the z-direction and the other lens being used to achieve focusing in the y-direction. However, both functions may be achieved by a single lens, when for example the focusing is achieved by a multipole lens.

Figure 5:
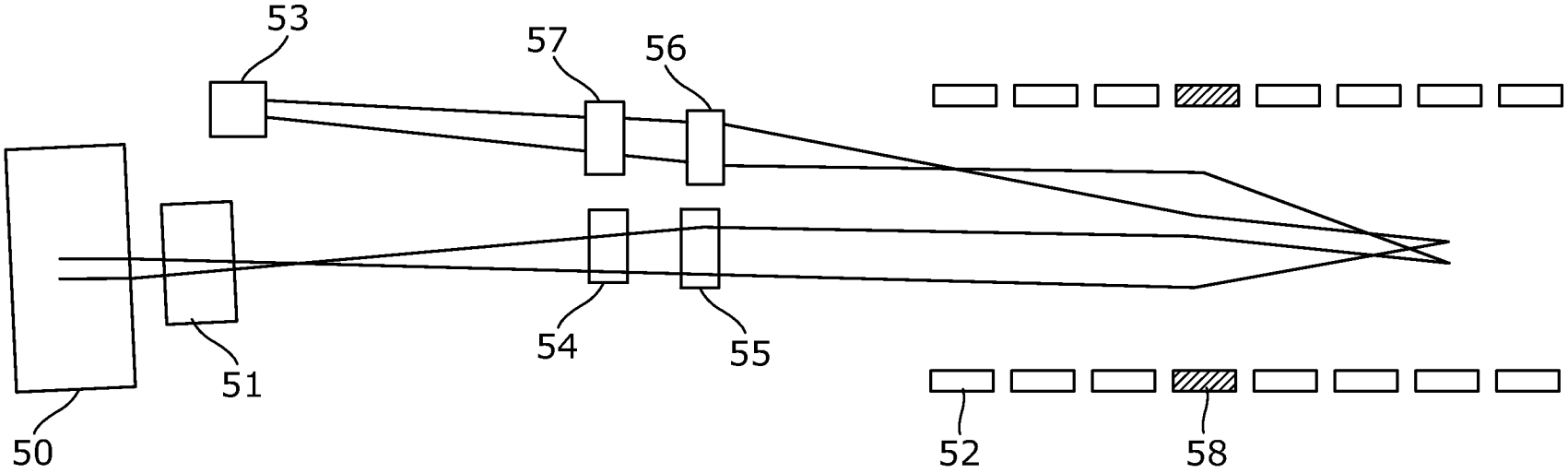
FIG. 5 shows a schematic diagram of a single-reflecting ToF mass analyser being an embodiment of the present invention.

A further embodiment of single reflecting ToF system is shown in FIG. 5. FIG. 5 illustrates a single reflecting ToF comprising two first lenses as described above for FIG. 3, two second lenses as described above for FIG. 4 and an ion mirror 52 having a lensing portion 58. In this case there is further focusing achieved in the z-direction by a lensing portion 58 within the ion mirror 52 itself. In this case the ion mirror is a multiple stage ion mirror, in which the voltage applied to each individual element or group of elements may be independently adjusted to form the lensing portion. In other embodiments the lensing portion may focus in the y-direction. Optionally, the ion mirror may be configured so that the lensing portion provides focusing in the y-direction and the z-direction.

Figure 6:
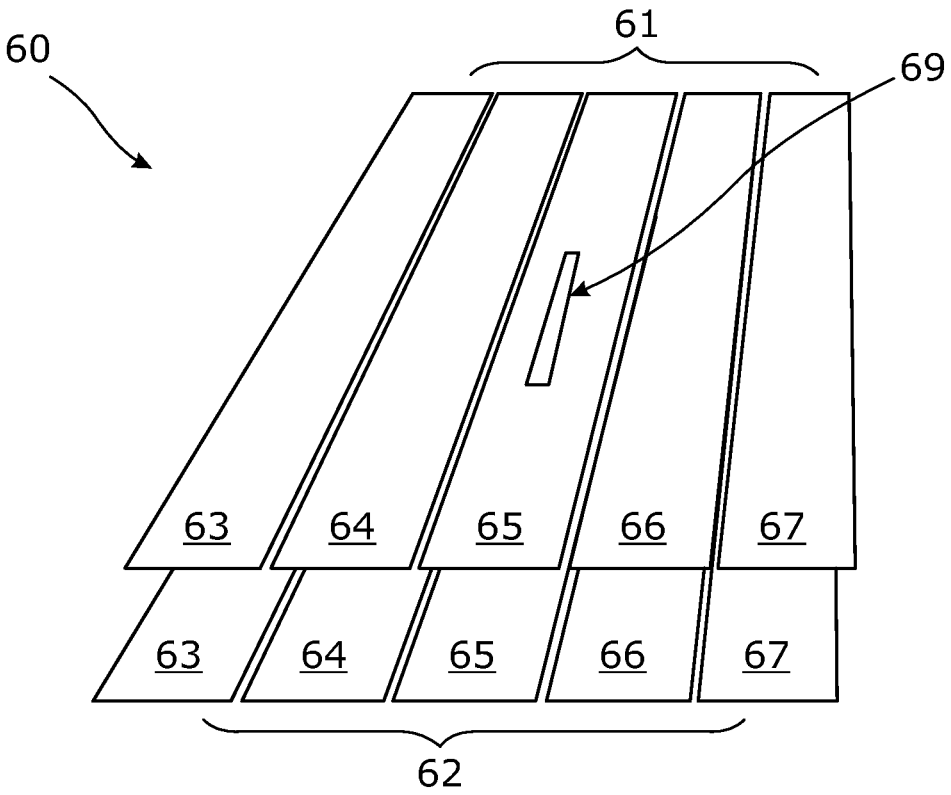
FIG. 6 shows a perspective view of a linear ion trap, with the electrodes formed from planar electrodes arranged in planar formation.
Figure 7A:
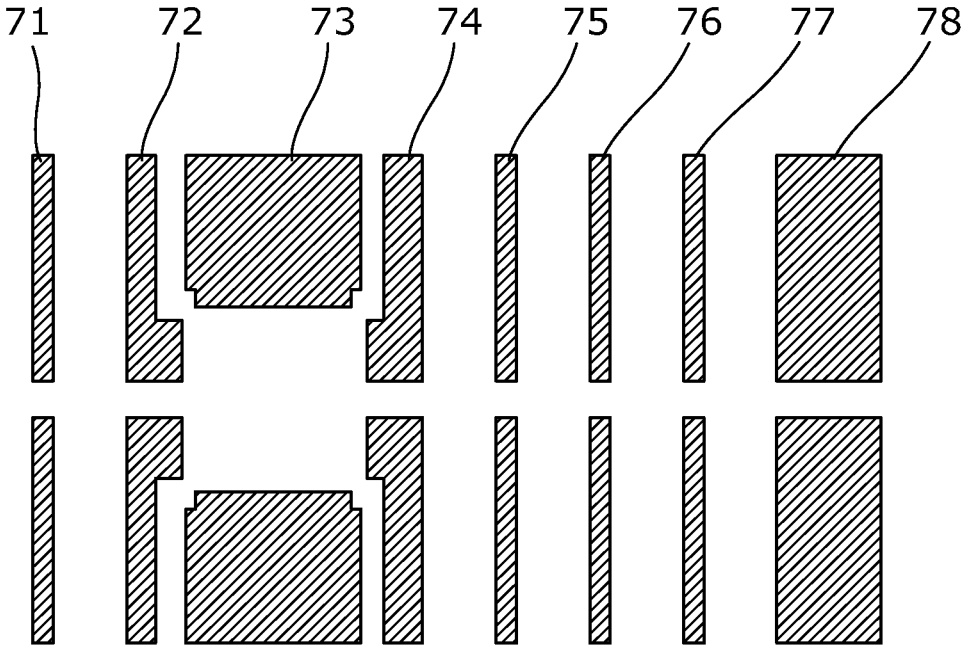
FIG. 7*a* shows a schematic xy cross-section through a linear ion trap, with the electrodes formed from planar electrodes arranged in square formation.
Figure 7B:
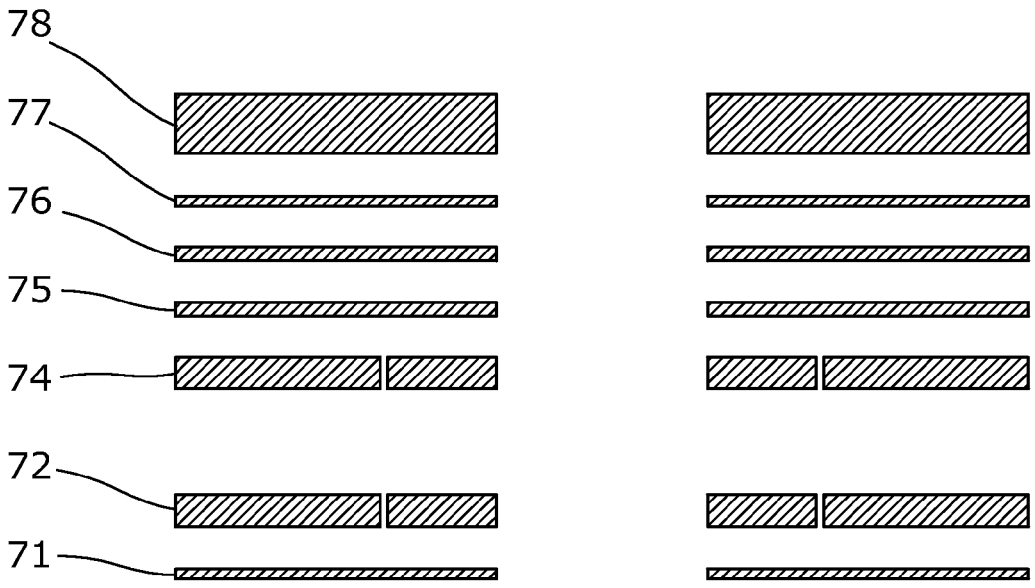
FIG. 7*b* shows a schematic xz cross-section through a linear ion trap, with the electrodes formed from planar electrodes arranged in square formation.

An ion source used in the present invention may be formed as a linear ion trap, with the electrodes formed from planar electrodes, arranged in planar formation as illustrated in FIG. 6, or in a square formation as shown in FIGS. 7*a* and 7*b*.

FIGS. 7*a* and 7*b* consist of focusing elements 75, 76, 77 and trapping elements 71, 72, 73, 74 and flight tube 78. During ion extraction elements 72 and 74 are used for extracting ions from said ion trap.

FIG. 6 shows a planar linear ion trap 60 with trapping elements 63,64,65,66,67 which are used in combination for generating RF trapping fields, and also used for extraction of the ions from the trapping region. Positive voltages are applied to electrodes 63, 64, 65, 66 and 67 in the lower electrode plane 62 and negative voltages to electrodes 63, 64, 65, 66 and 67 in the upper plane 61. Ions are extracted through slit 69.

Example 1

The current invention is illustrated below in relation to the trap-ToF method, but it is not only restricted to this category. On the contrary, the current invention may apply equally to all prior art methods of preparing ions for ToF analysis, and all systems having a ion pulsing means.

An ion source may be formed as a linear ion trap, with the electrodes formed from planar electrodes, arranged in planar formation as illustrated in FIG. 6, or in a square formation as shown in FIGS. 7*a* and 7*b*. For this example the ion source shown in FIGS. 7*a* and 7*b* was used.

This example compares Δt, that is peak width due to the arrival of species with a single m/z value at the detector for a ToF mass analyser comprising first and second lenses and an ion mirror having a lensing portion and a ToF mass analyser comprising an ion mirror having a lensing portion, but no first or second lens.

Figure 8A:
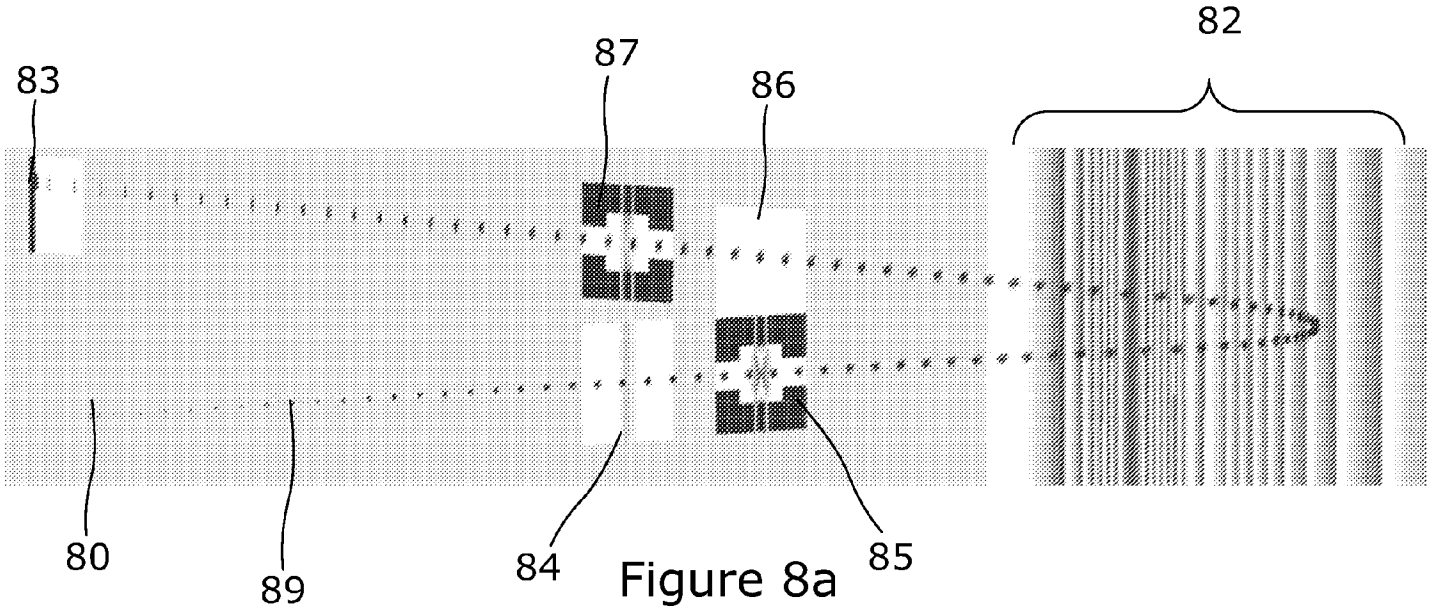
FIG. 8*a* shows a schematic of an ion group travelling through a ToF mass analyser being an embodiment of the present invention, viewed in the xy plane.
Figure 8B:
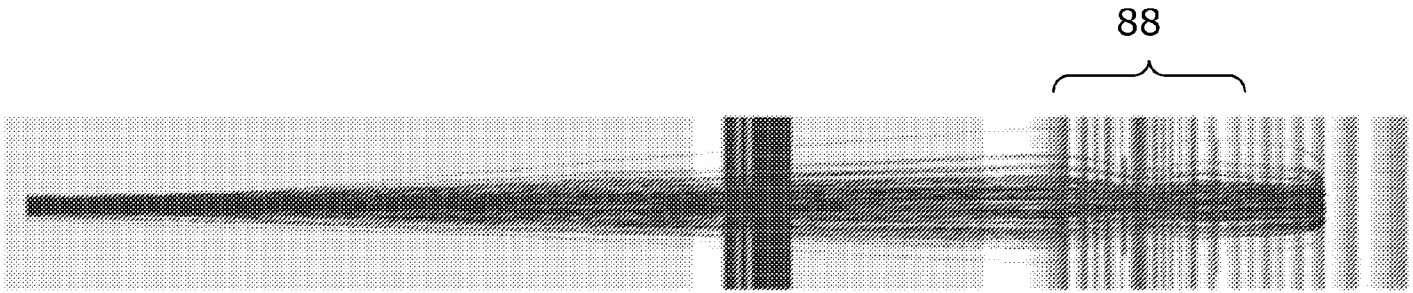
FIG. 8*b* shows a computer simulation of ion trajectories though the ToF mass analyser of FIG. 8*a*, viewed in the xz plane.
Figure 8C:
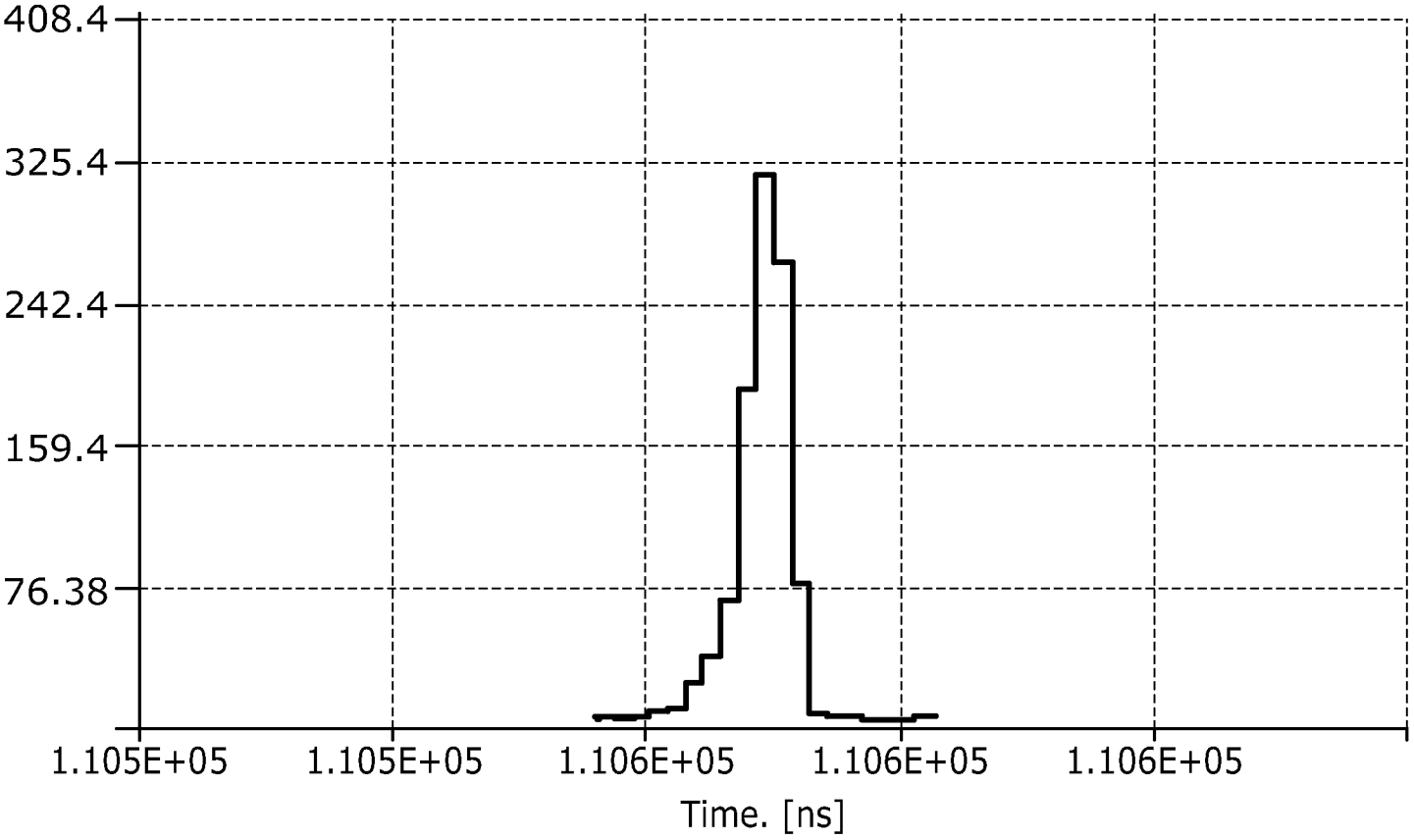
FIG. 8*c* shows a graphical representation, obtained by computer simulation, of the arrival time of ions of a single m/z value at the detector in a ToF mass analyser being an embodiment of the present invention.

The ToF mass analyser configuration used for the simulation shown in FIGS. 8*a* to 8*c* is as described in FIG. 5 above, this ToF combines all three proposals listed above. The ToF mass analyser is also illustrated in FIG. 8*a* and includes an ion source of the type shown in FIGS. 7*a* and 7*b*; a first z lens 84 and a first y lens 85; a second z lens 86 and second y lens 87; and a planar ion mirror 82 having a lensing portion 88 for focusing in the z direction.

FIG. 8*a* shows an ion group trajectory through the ToF mass analyser in the xy plane by an ion group 89. This figure illustrates that the ion group arriving at detector 83 is tightly packed in the x-direction compared to the ion group at an earlier stage of its flight, for example, within the ion mirror.

FIG. 8*b* shows an ion group trajectory through the ToF mass analyser in the xz plane by an ion group 89. This figure shows the focusing of the ion group in the z-direction by the lensing portion 88 of the ion mirror 82.

FIG. 8*c* shows the results of a computer simulation for the arrival time of ions of a single m/z value at the detector travelling through the ToF shown by FIGS. 8*a* and 8*b*, the time scale on the computer simulation was digitized at 0.25 ns resolution. This figure shows that Δt, peak width measured at FWHM due to the arrival of species with a single m/z value at the detector (an ion group), for the system shown in FIGS. 8*a* and 8*b* is 0.75 ns.

Figure 9A:
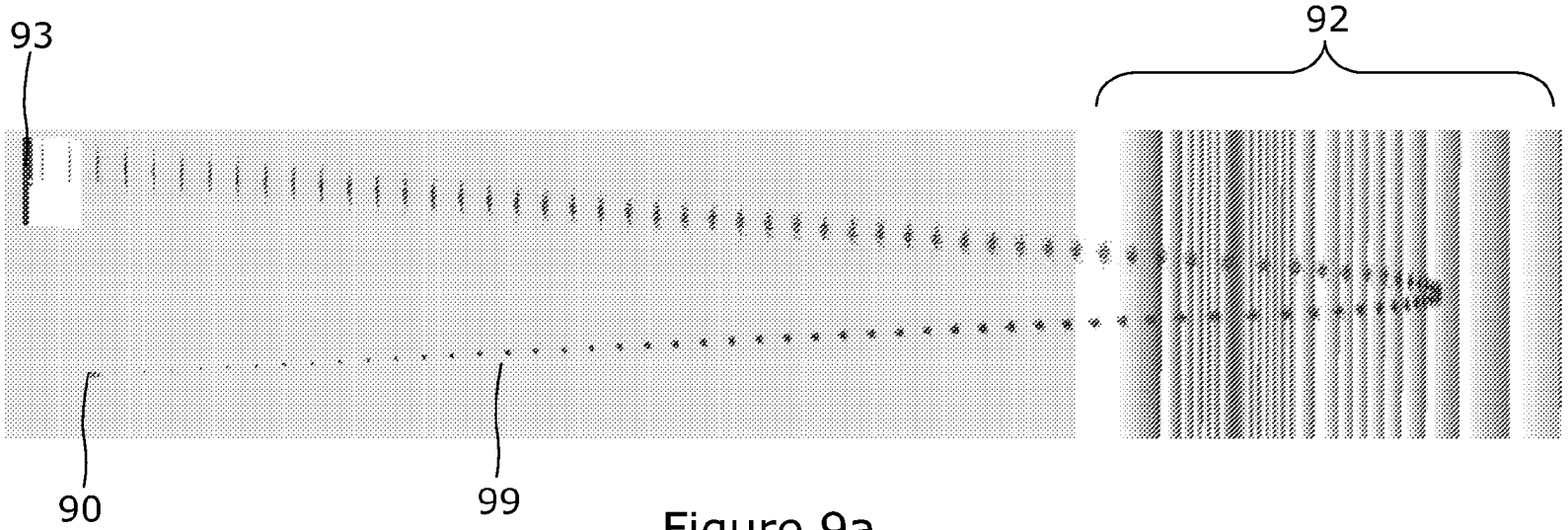
FIG. 9*a* shows a schematic of an ion group travelling through a ToF mass analyser of the prior art.
Figure 9B:
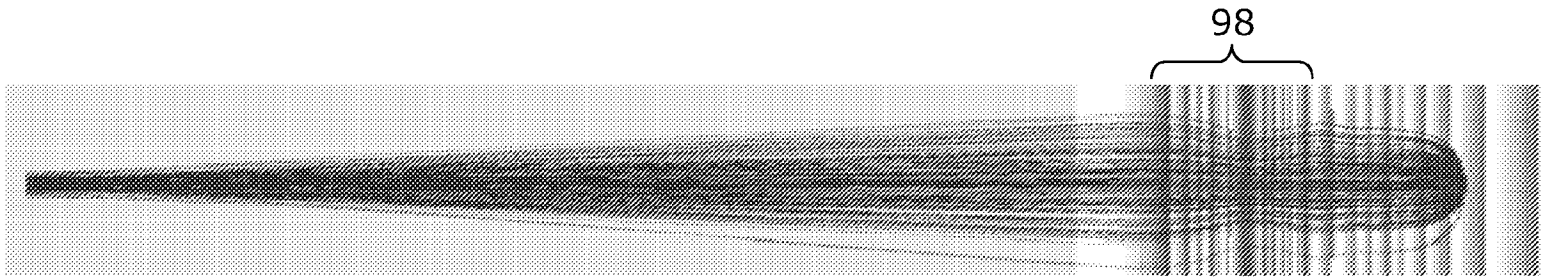
FIG. 9*b* shows a computer simulation of ion trajectories though a ToF mass analyser of the prior art.
Figure 9C:
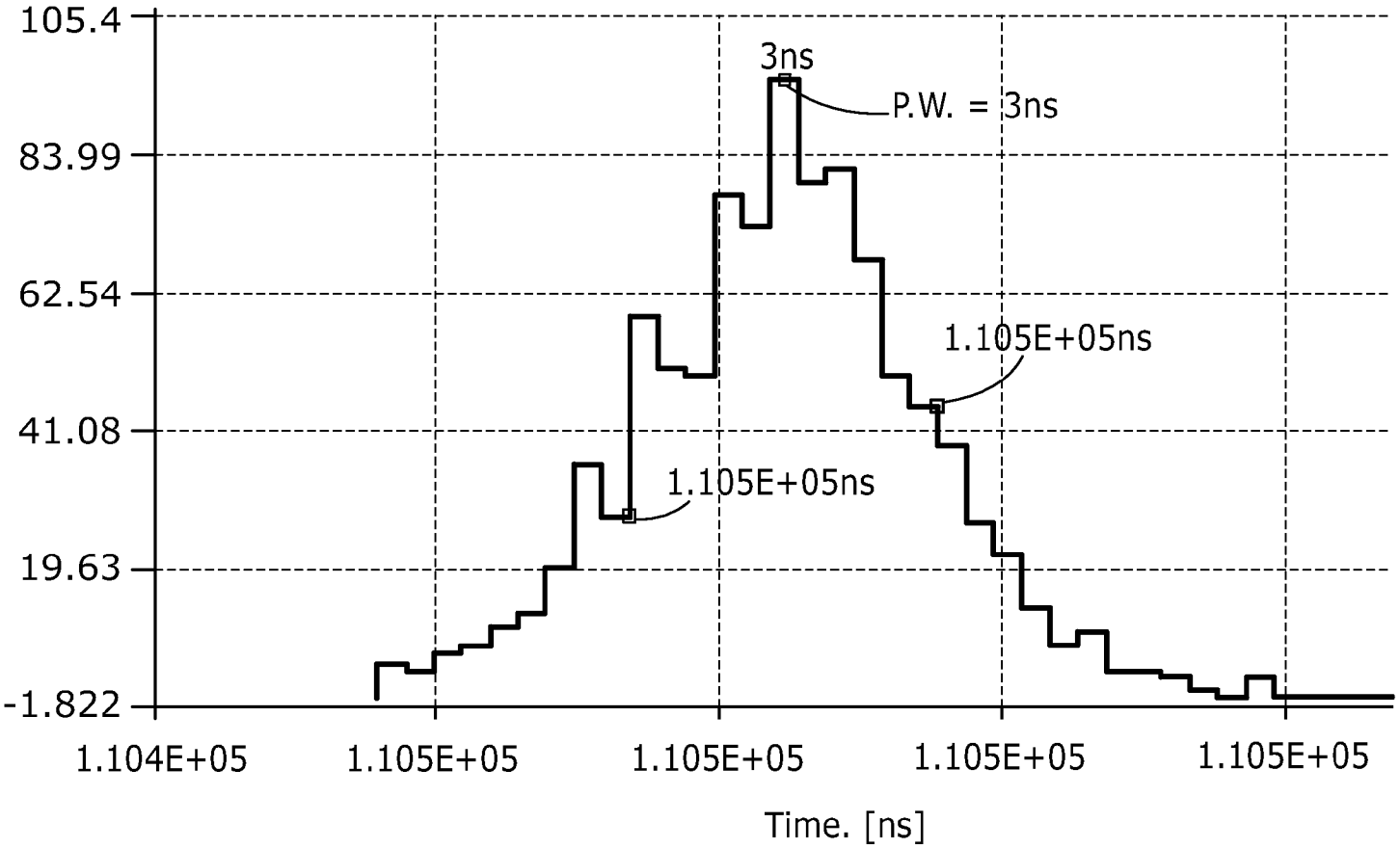
FIG. 9*c* shows a graphical representation, obtained by computer simulation, of the arrival time of ions of a single m/z value at the detector in a ToF mass analyser of the prior art.

For comparison, and to illustrate the advantage of the intermediate lenses a computer simulation was also done for a ToF mass analyser configuration shown in FIG. 9*a*. The ToF mass analyser shown in FIG. 9*a* is an embodiment of the second proposal including an ion source of the type shown in FIGS. 7*a* and 7*b*, and an ion mirror 92 having a lensing portion 98. Therefore the ToF mass analyser used in the simulations shown in FIGS. 9*a* to 9*c* is as described for FIGS. 8*a* to 8*c* without at least one first or second lenses. FIG. 9*c* shows that Δt, peak width due to the arrival of species with a single m/z value at the detector (an ion group). The computer simulation was digitized at 0.25 ns resolution, for the system shown in FIGS. 9*a* and 9*b* the peak width is 3 ns.

Therefore, the combined effect of the first and second lenses is to reduce Δt from 3 ns to 0.75 ns. In this example, the resolving power is increased from 19K to 76K by the introduction of the first and second lenses. The ToF mass analysers used in these simulations were 2 m long systems. For such long system the contributions ΔtlΔy, ΔtlΔVy, ΔtlΔz and ΔtlΔVz become large, a total contribution of 2 to 3 ns, and thus severely limiting the resolving power. The results of these simulations show that introducing the first and second lenses improves the resolving power significantly.

Figure 10A:
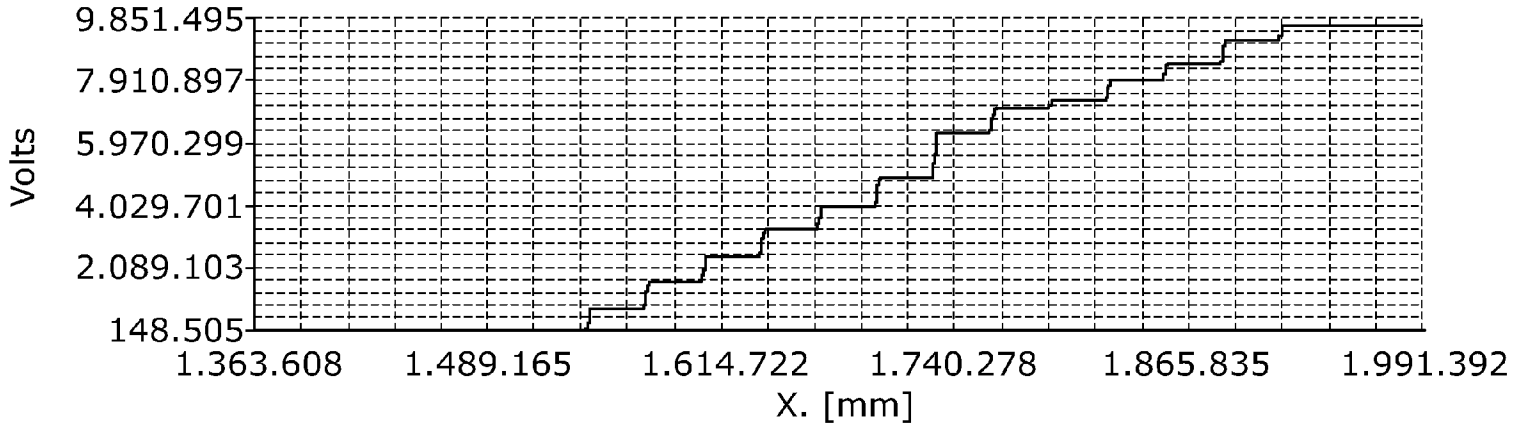
FIG. 10*a* is a graphical plot showing an example of the mirror potentials for a ion mirror optimised for energy focusing alone.
Figure 10B:
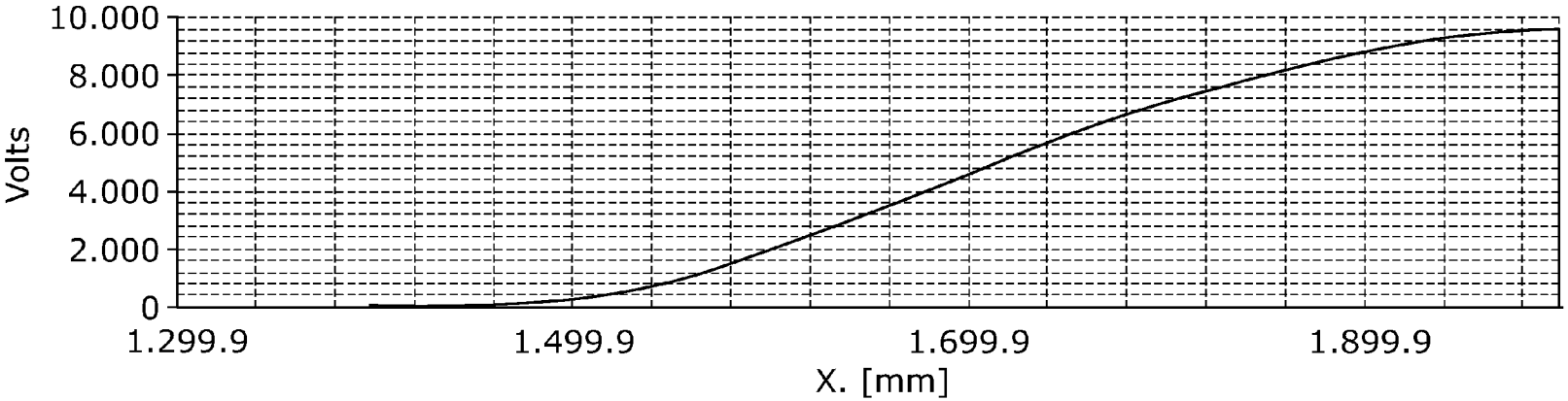
FIG. 10*b* is a graphical plot showing the resulting axial potential for a mirror potentials applied to the mirror electrodes as shown in FIG. 10*a* that was optimised for energy focusing alone.
Figure 10C:
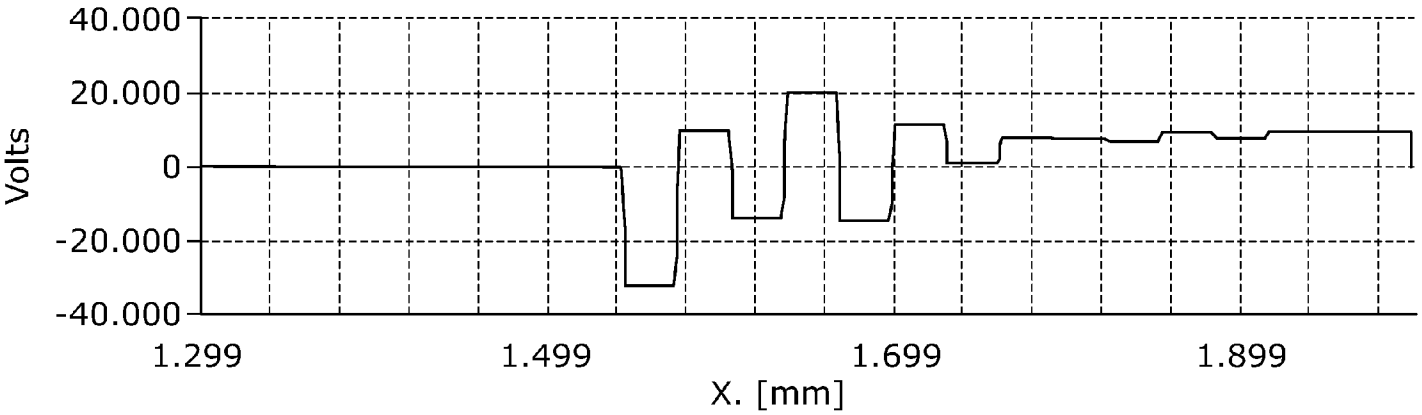
FIG. 10*c* is a graphical plot showing the mirror potential for a mirror optimised for combined energy and spatial focusing.
Figure 10D:
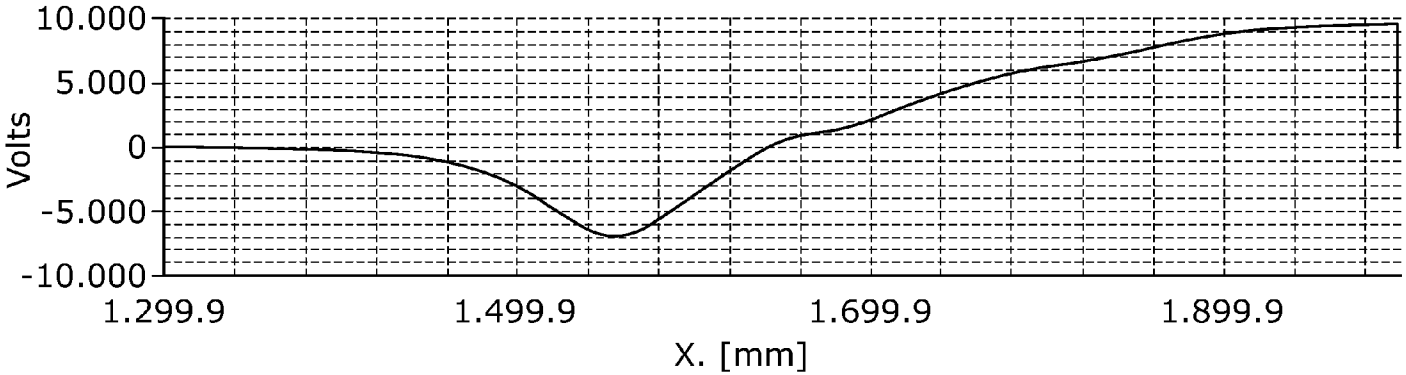
FIG. 10*d* is a graphical plot showing the resulting axial potential for the potentials applied to the mirror electrodes as shown in FIG. 10*c* that was optimised for energy focusing alone and spatial focusing.

In this example spatial focusing is also provided by the ion mirror. The ion mirror has 14 electrodes, and the voltage applied to each one may be adjusted independently, to provide simultaneously a temporal focus and a spatial focus at the detector. The presence of the spatial focus further significantly reduces (improves) the temporal focus. It is an aspect of the current invention, that the multistage mirror is used in combination with the placement of first and second lenses for spatial focusing. The consequence of using a multistage mirror to provide the additional function of space focusing can be seen in FIGS. 8*b* and 9*b*; this is illustrated further in FIGS. 12*a* and 12*b* as discussed below. FIG. 10*a* shows the mirror potential for a mirror that was optimised to provide energy focusing alone. FIG. 10*b* shows the axial potential for a mirror that was optimised to provide energy focusing alone. FIG. 10*c* shows the mirror potential for a mirror optimised for energy focusing and spatial focusing. FIG. 10*d* shows the axial potential for a mirror optimised for energy focusing and spatial focusing. There is provided in this particular solution six separate lenses (this is the "lensing portion"), which provide in combination, collimation of the reflected ion beam in the xz plane at the detector without deterioration of the temporal focus, that is deterioration of energy focusing term (ΔtlΔx) or increasing of the other orthogonal lateral aberrations, that is ΔtlΔy and ΔtlΔVy.

Figure 11:
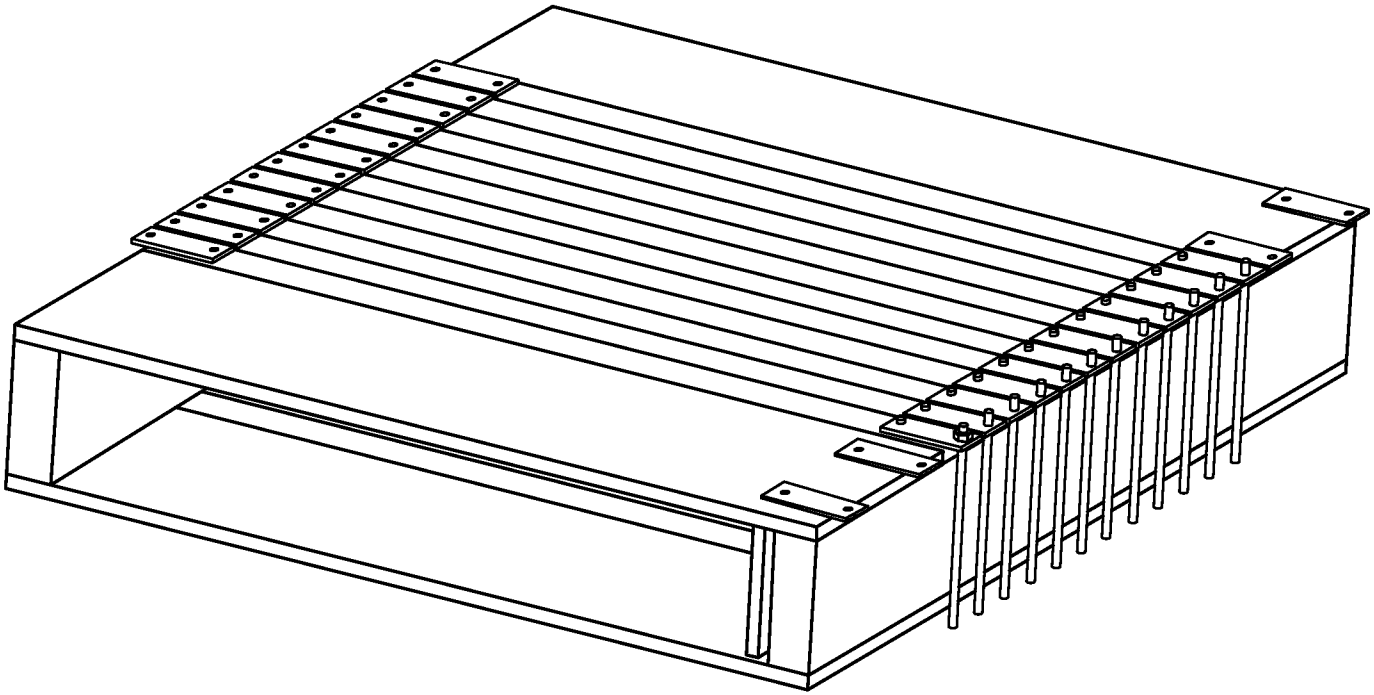
FIG. 11 shows a perspective view of a planar ion mirror being an embodiment of the present invention.

The mirror potentials shown in FIGS. 10*a* to 10*b* are only by way of example for the geometry of the mirror show in FIG. 11. The voltages that must be applied to provide the optimal mirror potentials must be modified for ion mirrors of different geometry.

Example 2

Figure 12A:
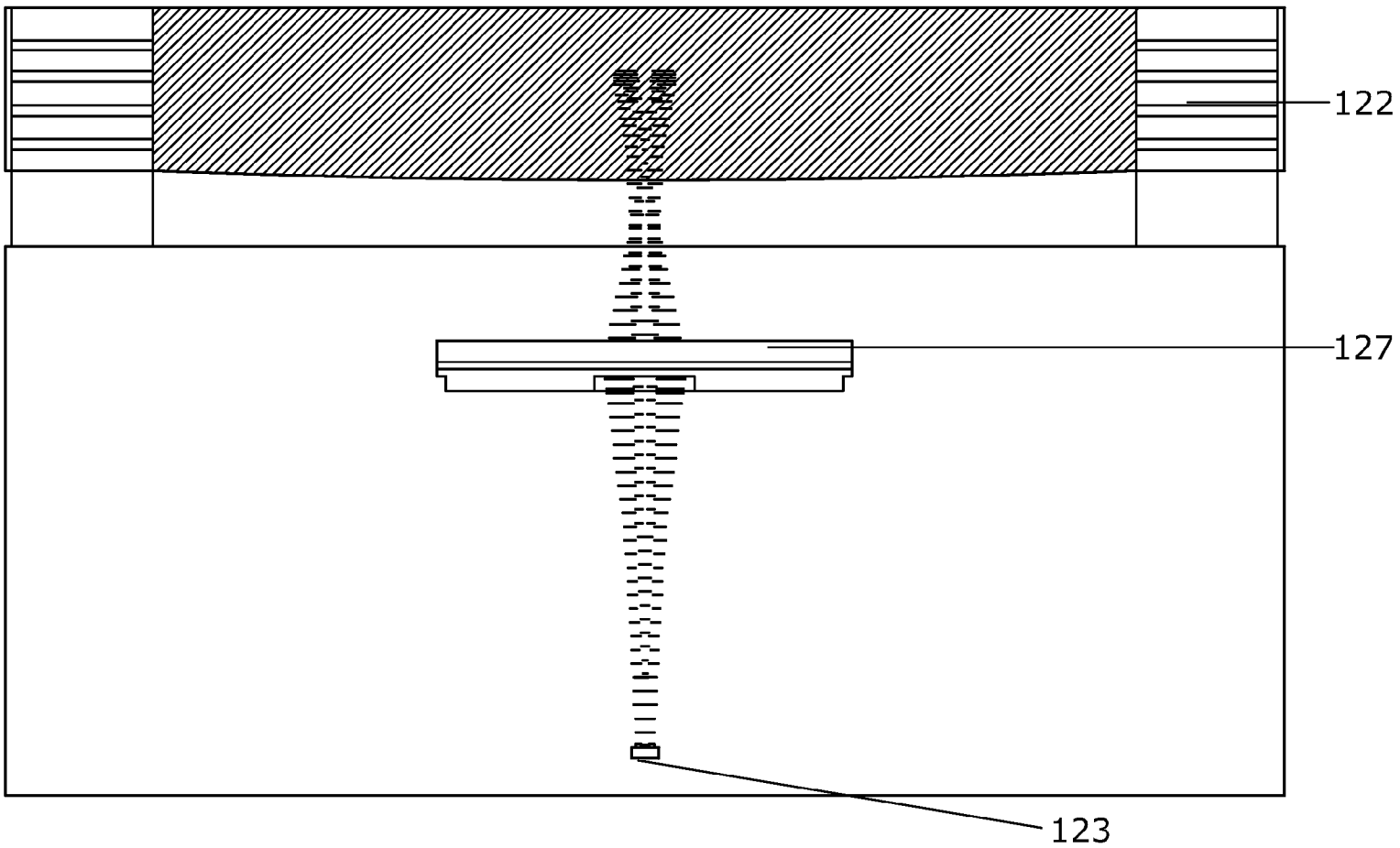
FIG. 12*a* is a xz plane computer simulation of an ion trajectory through a ToF mass analyser with an ion mirror of the prior art.
Figure 12B:
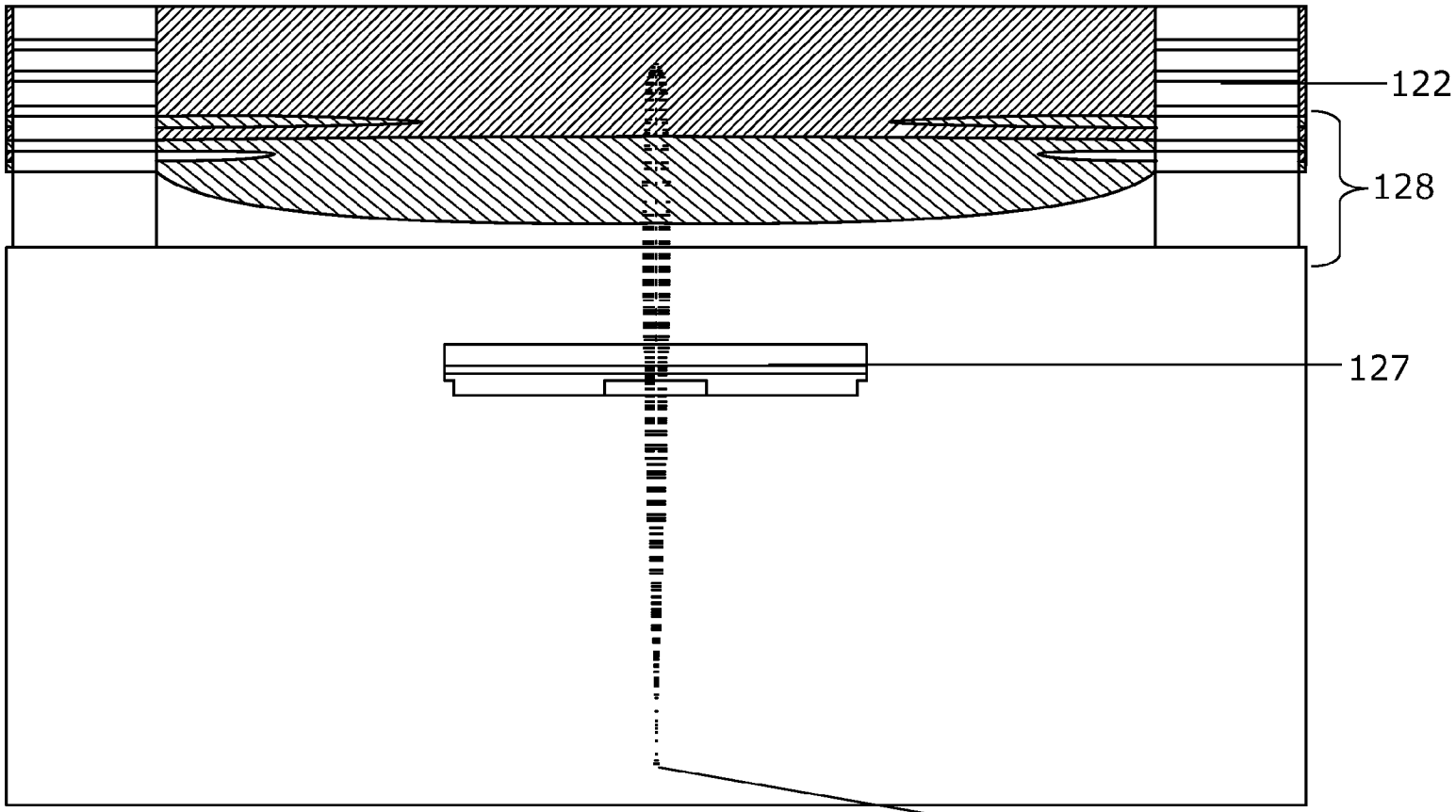
FIG. 12*b* is a xz plane computer simulation of an ion trajectory through a ToF mass analyser comprising an ion mirror having a lensing portion.

FIGS. 12*a* and 12*b* are computer simulations of ion trajectories in the xz plane from the ion mirror 122 via z lens 127 to the detector 123 in a ToF mass analyser. The ion mirror of FIG. 12*a* is an ion mirror of the prior art. The ion mirror of FIG. 12*b* includes lensing portion 128.

FIG. 12*a* shows that an ion mirror of the prior art provides a strong focusing effect: a cross over of ion paths is formed within the ion mirror, the ion beam is strongly divergent as it emerges from the ion mirror. In the example shown in FIG. 12*a* z lens 127 can be used to correct this divergence to achieve minimum radial spread of the ion beam in the z-direction and therefore improved temporal focusing at the detector 123. Although mass resolution is only determined by the temporal spread of an ion group at the detector, i.e. axial spread of the ion group in the x-direction, due to the divergence of the ion beam caused by an ion mirror of the prior art, lateral spread in the z-direction (and/or y-direction) results in axial spread in the x-direction at the detector if not corrected.

FIG. 12*b* shows the effect of including a lensing portion in the ion mirror used for the computer simulation shown in FIG. 12*a*. From FIG. 12*b* it can be seen that the lensing portion 128 of the ion mirror 122 corrects the divergence of the ion beam caused by the ion mirror without this lensing portion. Therefore, in this example, the terms ΔtlΔz and ΔtlΔVz are minimised by the lensing portion instead of z lens 127.

Example 3

Figure 13:
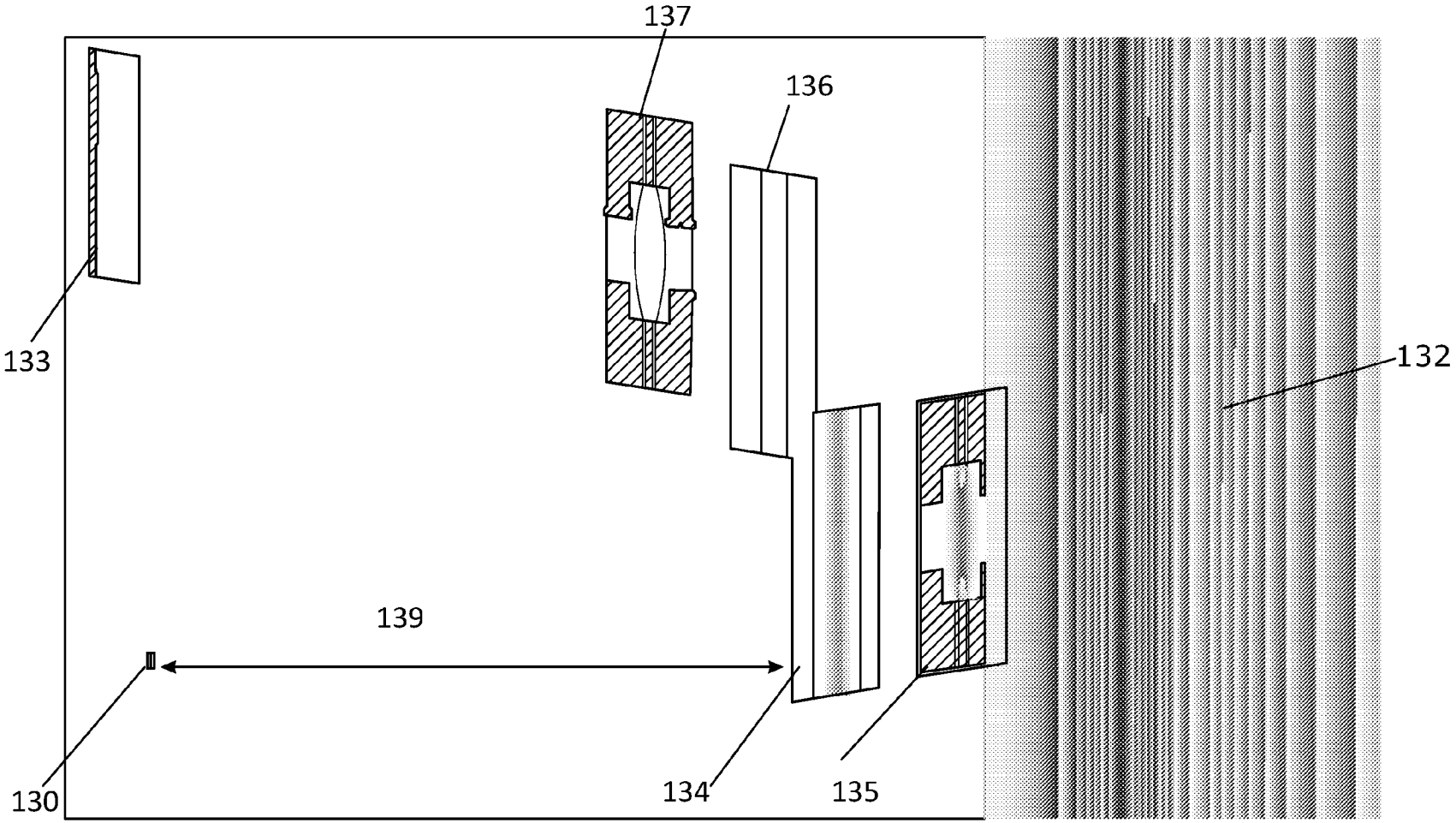
FIG. 13 shows a model of the time of flight simulation used to obtain the results show in FIG. 14 and table 1.

A computer simulation was carried out using the ToF mass analyser model shown in FIG. 13. The model ToF comprises an LIT ion source 130; a first y lens z 134 and y lens 135; ion mirror 132 having a lensing portion (not shown); second z lens 136 and second y lens 137; and detector 133. This simulation shows the effect of position of the first lenses between the ion source 130 and the ion mirror 132, the distance 139 between the ion source.

The model is a 2000 mm long ToF (measured from the of the mid-point of the ion source to the back of the ion mirror). The distance 139 in the x-direction from the (mid point of the) ion source 130 to the front edge of the first lens was varied between 100 and 1100 mm, and the position in y correspondingly altered to keep the elements centred around the ion flight path. The distance between first z lens 134 and first y lens 135 was held constant, as were the positions of all other components. For each position optimisation was carried out with relevant ion groups for first and second y lenses 135, 137 and first and second z lenses 134 and 136. Optimisation was then carried out for the lensing portion of the ion mirror. Optimisation was thus achieved for each lens position, that is the minimum possible temporal resolution was found in each case at the detector by varying the voltages applied to the lenses. Simulations were performed with a realistic initial phase space distribution, for a digital LIT ion source.

Figure 14:
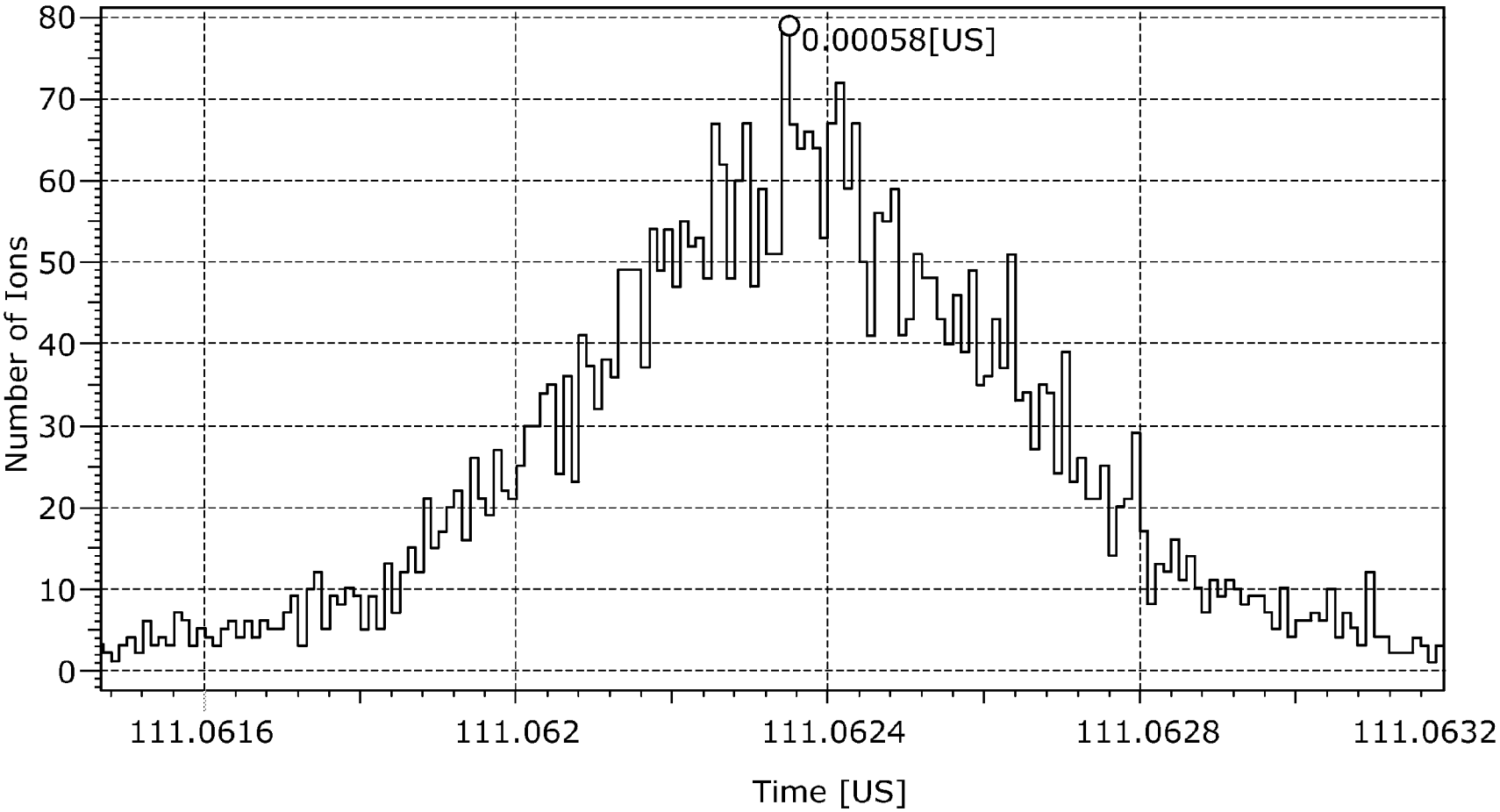
FIG. 14 shows a graphical plot of the arrival time of ions of a single m/z value at the detector in a ToF mass analyser generated by the simulation shown in FIG. 13.
Figure 15:
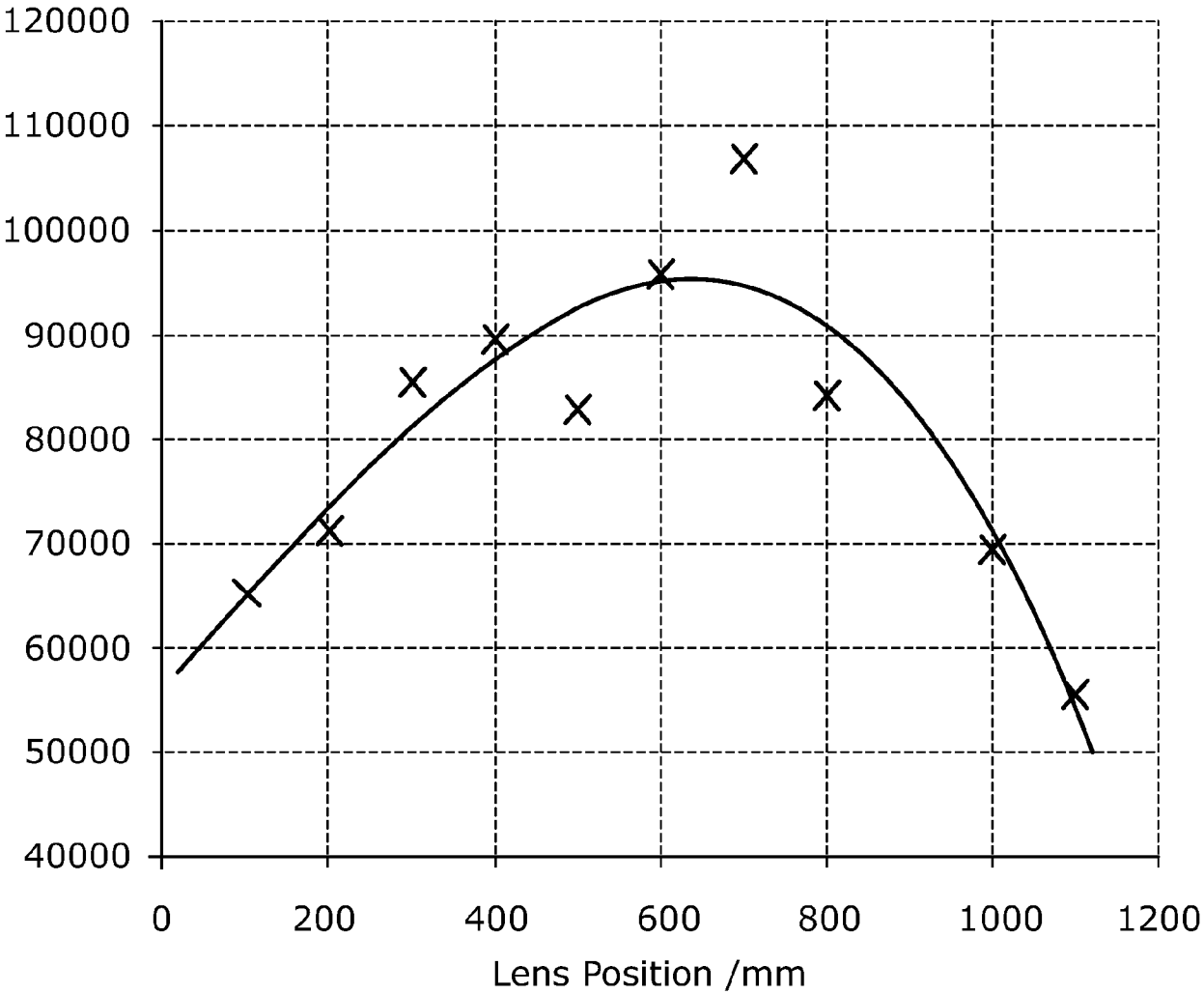
FIG. 15 shows a graphical plot showing the relationship between lens position in a ToF mass analyser of the present invention and resulting mass resolving power.

A typical ToF peak generated by simulation is shown in FIG. 14. The raw data and calculated values of resolving power are reported in Table 1, and the relationship between lens distance and resolving power shown in FIG. 15.

Table 1 below shows simulation results gathered with variation of the lens distance in the x-direction from the ion source.

TABLE 1

| Lens Distance/ mm | Peak FWHM/ns | Time of Flight/ μs | Mass Resolving Power |
|---|---|---|---|
| 100 | 0.85 | 111 | 65300 |
| 200 | 0.78 | 111 | 71200 |
| 300 | 0.65 | 111 | 85400 |
| 400 | 0.62 | 111 | 89600 |
| 500 | 0.67 | 111 | 82900 |
| 600 | 0.58 | 111 | 95800 |
| 700 | 0.52 | 111 | 106800 |
| 800 | 0.66 | 111 | 84100 |
| 1000 | 0.8 | 111 | 69400 |
| 1100 | 1.0 | 111 | 55500 |

In this example the mass resolving power is shown to be highest with the first lens positioned 700 mm from the ion source. Resolving power declines significantly as the lenses are moved away from this optimum position, particularly as the lens distance is increased from this position. This example illustrates that the positioning of a y and z focusing lens in the drift space between the ion source and the ion mirror provides dramatic improvement in the Mass Resolving power of the Analyser. The results shown in Table 1 are also shown in a graph in FIG. 15.

As discussed in Examples 4 to 6 below, each proposal of the present invention, being at least one first lens; the ion mirror having a lensing portion; and at least one second lens, contribute to solving the problem of degradation of the time focus at the detector due to the finite lateral size of the ion beam delivered by the ion source. The Examples below show how each of the proposals of the present invention provide an improvement in resolving power for a ToF mass analyser if applied individually. However, it will be understood that applying all proposals in combination in one ToF mass analyser may provide a more drastic improvement in resolving power compared to their individual application. The combination in embodiments of (1) the or each first lens; (2) the ion mirror having a lensing portion; and (3) the or each second lens led to an improvement of mass resolving power a factor greater than 5 with respect to the prior art having a Trap-ToF analyser configuration.

Example 4

A series of simulations were done using the model ToF mass analyser shown in FIG. 13 with the lensing portion of the ion mirror and the second lenses 136, 137 removed. Results are shown in Table 2 below. Four simulation runs were taken. For the first simulation run no first lenses 134, 135 were present in the model ToF analyser and the ion mirror was without lensing portion, the electrode potentials applied to provide a 2 stage gridless ion mirror. The second simulation was done for a ToF mass analyser having a first z lens 134. The third simulation was done for a ToF mass analyser having a first y lens 135, but no first z lens 135. The fourth simulation was done for a ToF mass analyser having both first y lens 135 and first z lens 134.

TABLE 2

| Run | | Time of Flight/ μs | FWHM/ ns | Mass Resolving Power |
|---|---|---|---|---|
| 1 | 2-Stage gridless ion mirror, no 1st lenses | 117 | 6.1 | 9600 |
| 2 | +1$^{st}$ z element | 117 | 4.9 | 12000 |
| 3 | +1$^{st}$ y element | 118 | 4.9 | 12000 |
| 4 | +1$^{st}$ z and y elements | 118 | 3.9 | 15100 |

These examples serve to illustrate the first proposal of the invention, as Table 2 indicates the resolving power improves significantly from 9.6 k to 12 k for by employing a first z lens 134 alone or a first y lens 135 alone, and increases considerably to 15 k when both y and z lenses 134, 135 are employed together.

Thus, reducing the lateral spread of the ion group in the region of the turn-around point in only the y- or z-direction is sufficient to improve the mass resolution of a single reflecting time of flight mass analyser.

Example 5

A further set of simulations were done to provide illustration of the second proposal, again using the model ToF mass analyser shown in FIG. 13. Each of the first and second lenses 134, 135, 136, 137 were removed from the simulation model. Two simulations were undertaken. In the first simulation the electrode potentials were applied to the ion mirror to provide a 2-stage gridless ion mirror. The mirror potentials in a 2-stage gridless ion mirror are applied, as in the prior art, by two adjustable voltages. In obtaining the reported figures the voltages were optimised using a series of numerical optimisation calculations. In the second simulation the electrode potentials were applied to the ion mirror to provide a lensing portion according to the second proposal. In this case there were 14 mirror electrodes, each having an individual adjustable supply voltage. The 14 supply voltages were optimised using numerical methods. It should be understood that in the case of optimising 14 variable voltages a series of numerical optimisation calculations is necessary.

Simulation results are shown in Table 3 below.

TABLE 3

| Run | | Time of Flight/ μs | FWHM/ ns | Mass Resolving Power |
|---|---|---|---|---|
| 1 | 2-Stage gridless ion mirror | 117 | 6.1 | 9600 |
| 2 | ion mirror with lensing portion | 111 | 3.9 | 14300 |

In each case the mirror potentials were optimised numerically, to provide the highest mass resolving power. These results serve to illustrate that an ion mirror having a lensing portion compared to an optimised two stage reflectron gridless ion mirror, having the same physical form provides an improvement in the resolving power of the ToF analysers, according to the second proposal of the invention. In this example the addition of a lens portion, provided an improvement in resolving power from 9.6 k to 14.3 k.

Example 6

A series of computer simulation were undertaken using the model ToF mass analyser according to FIG. 13 with the first lenses 134, 135 and the lensing portion of the ion mirror removed, that is the electrode potentials were applied to provide a standard 2-stage grid-less ion mirror with two variable voltages. Four simulation runs were undertaken: in the first simulation (run 1) no second lenses 136, 137 were present in the model TOF analyser; in the second simulation (run 2) z lens 136 positioned between the ion mirror and the detector (second z lens) was present; in the third simulation (run 3) a y lens 137 positioned between the ion mirror and the detector (second y lens) was present; and in the fourth simulation (run 4) z lens 136 and a y lens 137 positioned between the ion mirror and the detector (second z and y lenses) were present. Simulation results are shown in Table 4 below. In each case the lens elements and the voltages applied to the ion mirror were optimised by numerical optimisation methods.

TABLE 4

| Run | | Time of Flight/ns | FWHM/ns | Mass Resolving Power |
|---|---|---|---|---|
| 1 | 2-Stage Reflectron | 116500 | 6.1 | 9600 |
| 2 | +2$^{nd}$ z element | 116500 | 4.8 | 12100 |
| 3 | +2$^{nd}$ y element | 116500 | 5.0 | 11600 |
| 4 | +2$^{nd}$ z and y elements | 116500 | 4.9 | 11900 |

This example simulation serves to demonstrate the third proposal of the invention, that is second lenses 136, 137 without the first lenses or the ion mirror having a lensing portion provide improvement in the observed resolving power when used individually or in combination.

The above examples illustrate the invention for one particular system, having one particular ion source (LIT), for one particular ion mirror (planar) and one particular system length (2 m). However, the skilled reader understands that similar improvements will be achieved with other embodiments of a ToF mass analyser as described herein, for example ToF mass analysers with different types of ion source, different types of ion mirror and different system size.

The following statements provide general expressions of the disclosure herein.

A. A time of flight analyser comprising:

a pulsed ion source;

a non-linear ion mirror having a turn-around point;

a detector;

an ion flight axis extending from the pulsed ion source to the detector via the turn-around point of the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group, at the turn-around point, along the ion flight axis towards the detector, the passage of the ion group through the non-linear ion mirror causing a spatial spread of the ion group in the x-direction at the detector due to the lateral spread of the ion group within the ion mirror, the time of flight mass analyser having at least one lens positioned between the ion source and the ion mirror, wherein the or each lens is configured to reduce said lateral spread so as to provide a local minimum of lateral spread within the ion mirror thereby reducing the spatial spread of the ion group in the x-direction at the detector.

B. The time of flight analyser according to statement A, wherein the or each lens is configured to reduce said lateral spread to a local minimum at or near the turn-around point.

C. The time of flight analyser according to statement A or statement B, wherein at least one lens is a y lens configured to reduce the lateral spread of the ion group in the y-direction so as to provide a local minimum in the y-direction within the ion mirror thereby reducing the spatial spread of the ion group in the x-direction at the detector.

D. The time of flight analyser according to any one of the preceding statements, wherein at least one lens is a z lens configured to reduce the lateral spread of the ion group in the z-direction so as to provide a local minimum in the z-direction within the ion mirror thereby reducing the spatial spread of the ion group in the x-direction at the detector.

E. The time of flight analyser according to any one of the preceding statements, wherein at least one lens is configured to reduce the lateral spread of the ion group in both the z-direction and the y-direction so as to provide a local minimum in both the z-direction and the y-direction within the ion mirror thereby reducing the spatial spread of the ion group in the x-direction at the detector.

F. The time of flight analyser according to any one of the preceding statements, wherein the or each lens is positioned within a region corresponding to 10% to 70% of the distance from the ion source to the turn-around point.

G. The time of flight analyser according to any one of the preceding statements, wherein the or each lens is positioned within a region corresponding to 20% to 40% of the distance from the ion source to the turn-around point.

H. The time of flight analyser according to any one of the preceding statements wherein the ion mirror comprises a lensing portion, wherein the lensing portion is configured to reduce the lateral spread of the ion group within the ion mirror so as to reduce the spatial spread of the ion group in the x-direction at the detector.

I. The time of flight analyser according to any one of the preceding statements comprising at least one first lens positioned on the ion flight axis between the ion source and the turn-around point of the non-linear ion mirror; and at least one second lens positioned on the ion flight axis between the non-linear ion mirror the detector, wherein the or each second lens is configured to reduce the lateral spread of the ion group so as to reduce the spatial spread of the ion group in the x-direction at the detector.

J. A method of mass analysis comprising the steps of: producing an ion pulse travelling in an axial direction (x-direction) along an ion flight axis, the ion flight axis extending from a pulsed ion source to a detector via a turn-around point of a non-linear ion mirror, the ion pulse having an ion group, the ion group consisting of ions with a single m/z value, the ion group having a lateral spread; reflecting the ion group at the turn-around point of the non-linear ion mirror along the ion flight axis towards the detector, the passage of the ion group through the non-linear ion mirror causing an axial spatial spread of the ion group at the detector due to the lateral spread of the ion group within the ion mirror; wherein the method includes reducing the lateral spread of the ion group so as to provide a local minimum of lateral spread within the ion mirror thereby reducing the spatial spread of the ion group in the axial direction (x-direction) at the detector.

K. A method of mass analysis according to statement J, wherein the lateral spread of the ion group is reduced to a local minimum at or near the turn-around point.

L. A method according to statement J or statement K comprising a step of reducing the lateral spread of the ion group within the non-linear ion mirror after reflection so as to reduce the spatial spread of the ion group in the x-direction at the detector.

M. A method according to any one of statements J to L comprising a step of reducing the lateral spread of the ion group between the ion mirror and the detector so as to reduce the spatial spread of the ion group in the x-direction at the detector.

N. A time of flight mass analyser comprising:

a pulsed ion source;

a non-linear ion mirror;

a detector;

an ion flight axis extending from the pulsed ion source to the detector via the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group along the ion flight axis towards the detector, the non-linear ion mirror causing a lateral spread of the ion group resulting in a spatial spread of the ion group in the x-direction at the detector, the non-linear ion mirror having a lensing portion configured to reduce said lateral spread within the ion mirror so as to reduce the spatial spread of the ion group in the x-direction at the detector.

O. The time of flight analyser according to statement N, wherein the lensing portion is configured to reduce the lateral spread of the ion group within the ion mirror in the y-direction.

P. The time of flight analyser according to statement N or statement O, wherein the lensing portion is configured to reduce the lateral spread of the ion group within the ion mirror in the z-direction.

Q. A time of flight mass analyser comprising:

a pulsed ion source;

a non-linear ion mirror;

a detector;

an ion flight axis extending from the pulsed ion source to the detector via the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group along the ion flight axis towards the detector, the non-linear ion mirror causing a lateral spread of the ion group resulting in a spatial spread of the ion group in the x-direction at the detector, the time of flight mass analyser having at least one lens positioned between the ion mirror and the detector, wherein the or each lens is configured to reduce said lateral spread so as to reduce the spatial spread of the ion group in the x-direction at the detector.

R. The time of flight analyser according to statement O, wherein the at least one lens includes a y lens configured to reduce the lateral spread of the ion group in the y-direction so as to reduce the spatial spread of the ion group, caused by the ion group passing through the ion mirror, in the axial direction at the detector.

S. The time of flight analyser according to statement Q or statement R, wherein the at least one lens includes a z lens configured to reduce the radial spread of the ion group in the z-direction so as to reduce the spatial spread of the ion group, caused by the ion group passing through the ion mirror, in the x-direction at the detector.

T. The time of flight analyser according any one of statements Q to S, wherein the or each lens is positioned within a region corresponding to 20% to 70% of the distance from the ion mirror to the detector.

U. A time of flight mass analyser according to any one embodiment as described herein, with reference to and as shown in FIGS. 2 to 15.

V. A method according to any one embodiment as described herein, with reference to and as shown in FIGS. 2 to 15.

The invention claimed is:

1. A time of flight analyser comprising:

a pulsed ion source;

a non-linear ion mirror having a turn-around point;

a detector;

an ion flight axis extending from the pulsed ion source to the detector via the turn-around point of the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group, at the turn-around point, along the ion flight axis towards the detector, the passage of the ion group through the non-linear ion mirror causing a spatial spread of the ion group in the x-direction at the detector due to the lateral spread of the ion group within the ion mirror, the time of flight mass analyser having at least one lens positioned between the ion source and the ion mirror, wherein the or each lens is configured to reduce said lateral spread so as to provide a local minimum of lateral spread within the ion mirror thereby reducing the spatial spread of the ion group in the x-direction at the detector.

2. The time of flight analyser according to claim 1, wherein the or each lens is configured to reduce said lateral spread to a local minimum at or near the turn-around point.

3. The time of flight analyser according to claim 1, wherein at least one lens is a y lens configured to reduce the lateral spread of the ion group in the y-direction so as to provide a local minimum in the y-direction within the ion mirror thereby reducing the spatial spread of the ion group in the x-direction at the detector.

4. The time of flight analyser according to claim 1, wherein at least one lens is a z lens configured to reduce the lateral spread of the ion group in the z-direction so as to provide a local minimum in the z-direction within the ion mirror thereby reducing the spatial spread of the ion group in the x-direction at the detector.

5. The time of flight analyser according to claim 1, wherein at least one lens is configured to reduce the lateral spread of the ion group in both the z-direction and the y-direction so as to provide a local minimum in both the z-direction and the y-direction within the ion mirror thereby reducing the spatial spread of the ion group in the x-direction at the detector.

6. The time of flight analyser according to claim 1, wherein the or each lens is positioned within a region corresponding to 10% to 70% of the distance from the ion source to the turn-around point.

7. The time of flight analyser according to claim 1, wherein the or each lens is positioned within a region corresponding to 20% to 40% of the distance from the ion source to the turn-around point.

8. The time of flight analyser according to claim 1, wherein the ion mirror comprises a lensing portion, wherein the lensing portion is configured to reduce the lateral spread of the ion group within the ion mirror so as to reduce the spatial spread of the ion group in the x-direction at the detector.

9. The time of flight analyser according to claim 1, further comprising at least one first lens positioned on the ion flight axis between the ion source and the turn-around point of the non-linear ion mirror; and at least one second lens positioned on the ion flight axis between the non-linear ion mirror the detector, wherein the or each second lens is configured to reduce the lateral spread of the ion group so as to reduce the spatial spread of the ion group in the x-direction at the detector.

10. A method of mass analysis comprising the steps of: producing an ion pulse travelling in an axial direction (x-direction) along an ion flight axis, the ion flight axis extending from a pulsed ion source to a detector via a turn-around point of a non-linear ion mirror, the ion pulse having an ion group, the ion group consisting of ions with a single m/z value, the ion group having a lateral spread; reflecting the ion group at the turn-around point of the non-linear ion mirror along the ion flight axis towards the detector, the passage of the ion group through the non-linear ion mirror causing an axial spatial spread of the ion group at the detector due to the lateral spread of the ion group within the ion mirror; wherein the method includes reducing the lateral spread of the ion group so as to provide a local minimum of lateral spread within the ion mirror thereby reducing the spatial spread of the ion group in the axial direction (x-direction) at the detector.

11. A method of mass analysis according to claim 10, wherein the lateral spread of the ion group is reduced to a local minimum at or near the turn-around point.

12. A method according to claim 10 comprising a step of reducing the lateral spread of the ion group within the non-linear ion mirror after reflection so as to reduce the spatial spread of the ion group in the x-direction at the detector.

13. A method according to claim 10, further comprising a step of reducing the lateral spread of the ion group between the ion mirror and the detector so as to reduce the spatial spread of the ion group in the x-direction at the detector.

14. A time of flight mass analyser comprising:

a pulsed ion source;

a non-linear ion mirror;

a detector;

an ion flight axis extending from the pulsed ion source to the detector via the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group along the ion flight axis towards the detector, the non-linear ion mirror causing a lateral spread of the ion group resulting in a spatial spread of the ion group in the x-direction at the detector, the non-linear ion mirror having a lensing portion configured to reduce said lateral spread within the ion mirror so as to reduce the spatial spread of the ion group in the x-direction at the detector.

15. The time of flight analyser according to claim 14, wherein the lensing portion is configured to reduce the lateral spread of the ion group within the ion mirror in the y-direction.

16. The time of flight analyser according to claim 14, wherein the lensing portion is configured to reduce the lateral spread of the ion group within the ion mirror in the z-direction.

17. A time of flight mass analyser comprising:

a pulsed ion source;

a non-linear ion mirror;

a detector;

an ion flight axis extending from the pulsed ion source to the detector via the non-linear ion mirror, the ion flight axis defining a x-direction; and a y-axis defining a y-direction and a z-axis defining a z-direction, the y-axis and the z-axis being mutually orthogonal and orthogonal to the ion flight axis, the pulsed ion source being configured to produce an ion pulse travelling along the ion flight axis, the ion pulse comprising an ion group, the ion group consisting of ions of a single m/z value, the ion group having a lateral spread in y- and z-directions, the non-linear ion mirror being configured to reflect the ion group along the ion flight axis towards the detector, the non-linear ion mirror causing a lateral spread of the ion group resulting in a spatial spread of the ion group in the x-direction at the detector, the time of flight mass analyser having at least one lens positioned between the ion mirror and the detector, wherein the or each lens is configured to reduce said lateral spread so as to reduce the spatial spread of the ion group in the x-direction at the detector.

18. The time of flight analyser according to claim 17, wherein the at least one lens includes a y lens configured to reduce the lateral spread of the ion group in the y-direction so as to reduce the spatial spread of the ion group, caused by the ion group passing through the ion mirror, in the axial direction at the detector.

19. The time of flight analyser according to claim 17, wherein the at least one lens includes a z lens configured to reduce the radial spread of the ion group in the z-direction so as to reduce the spatial spread of the ion group, caused by the ion group passing through the ion mirror, in the x-direction at the detector.

20. The time of flight analyser according to claim 17, wherein the or each lens is positioned within a region corresponding to 20% to 70% of the distance from the ion mirror to the detector.

21. The time of flight analyser according to claim 8, wherein the lensing portion is configured to reduce the lateral spread of the ion group within the ion mirror in the y-direction and/or the z-direction.

22. The time of flight analyser according to claim 8, wherein the ion mirror is a multiple stage ion mirror comprising a plurality of elements, in which the voltage applied to each individual element or group of elements has been independently adjusted to form the lensing portion.

* * * * *